US011728585B2

(12) United States Patent
Lu

(10) Patent No.: US 11,728,585 B2
(45) Date of Patent: Aug. 15, 2023

(54) COMPACT ELECTRICAL CONNECTOR WITH SHELL BOUNDING SPACES FOR RECEIVING MATING PROTRUSIONS

(71) Applicant: Amphenol East Asia Ltd., Taoyuan (TW)

(72) Inventor: Lo-Wen Lu, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 0 days.

(21) Appl. No.: 17/348,598

(22) Filed: Jun. 15, 2021

(65) Prior Publication Data

US 2021/0399451 A1 Dec. 23, 2021

Related U.S. Application Data

(60) Provisional application No. 63/040,422, filed on Jun. 17, 2020.

(51) Int. Cl.
*H01R 12/75* (2011.01)
*H01R 43/20* (2006.01)
(Continued)

(52) U.S. Cl.
CPC ..... *H01R 12/75* (2013.01); *H01R 12/58* (2013.01); *H01R 13/506* (2013.01); *H01R 13/64* (2013.01); *H01R 43/20* (2013.01)

(58) Field of Classification Search
CPC ..... H01R 12/58; H01R 12/79; H01R 12/716; H01R 12/721; H01R 12/7005;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1179448 C 12/2004
CN 1799290 A 7/2006
(Continued)

OTHER PUBLICATIONS

Extended European Search Report for European Application No. EP 11166820.8 dated Jan. 24, 2012.
(Continued)

*Primary Examiner* — Oscar C Jimenez
(74) *Attorney, Agent, or Firm* — Wolf, Greenfield & Sacks, P.C.

(57) ABSTRACT

An electrical connector includes a housing having a wall bounding, at least in part, an opening in which a plurality of terminals are exposed and a shell configured to encircle an outer surface of the wall. The shell may include: guide portions, a plurality of first portions configured to conform with the outer surface of the wall, a plurality of second portions spaced apart from the outer surface of the wall, and a plurality of hook portions configured to engage with an edge of the wall. The hook portions may be opposite the guide portions. Second portions, spaced from the outer surface of the wall, may be distributed around the bounding wall and may have different sizes to receive different projections from the plug, both preventing insertion of the plug in an incorrect orientation and counterbalancing the force on the connector housing during mating of a plug to the connector.

26 Claims, 13 Drawing Sheets

(51) Int. Cl.
*H01R 13/64* (2006.01)
*H01R 13/506* (2006.01)
*H01R 12/58* (2011.01)

(58) Field of Classification Search
CPC .. H01R 13/506; H01R 13/64; H01R 13/6272; H01R 13/6581; H01R 13/6594; H01R 24/60; H01R 43/20
See application file for complete search history.

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,751,479 A 6/1988 Parr
4,761,147 A 8/1988 Gauthier
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,013,262 A * 5/1991 Shibano ..... H01R 13/658 439/353
5,030,140 A * 7/1991 Sugiyama ..... H01R 13/6594 439/78
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Sahagian et al.
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,902,432 B2 6/2005 Morikawa et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,226,314 B2 6/2007 Lang et al.
7,285,018 B2 10/2007 Kenny et al.
7,303,438 B2 12/2007 Dawiedczyk et al.
7,335,063 B2 2/2008 Cohen et al.
7,344,409 B2 3/2008 Lang et al.
7,410,365 B2 8/2008 Wu
7,491,089 B2 2/2009 Lang et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,699,644 B2 4/2010 Szczesny et al.
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,794,278 B2 9/2010 Cohen et al.
7,806,729 B2 10/2010 Nguyen et al.
7,862,378 B1 * 1/2011 Wan ..... H01R 13/659 439/607.54
7,874,873 B2 1/2011 Do et al.
7,887,371 B2 2/2011 Kenny et al.
7,887,379 B2 2/2011 Kirk

(56) References Cited

U.S. PATENT DOCUMENTS 7,906,730 B2 3/2011 Atkinson et al.
7,914,304 B2 3/2011 Cartier et al.
7,985,097 B2 7/2011 Gulla
8,083,553 B2 12/2011 Manter et al.
8,182,289 B2 5/2012 Stokoe et al.
8,215,968 B2 7/2012 Cartier et al.
8,216,001 B2 7/2012 Kirk
8,257,095 B2 9/2012 Akai et al.
8,272,877 B2 9/2012 Stokoe et al.
8,348,701 B1 * 1/2013 Lan ..... H01R 12/716 439/607.19
8,371,875 B2 2/2013 Gailus
8,382,524 B2 2/2013 Khilchenko et al.
8,439,706 B2 5/2013 Sytsma et al.
8,454,381 B2 6/2013 Wu
8,657,627 B2 2/2014 McNamara et al.
8,715,003 B2 5/2014 Buck et al.
8,771,016 B2 7/2014 Atkinson et al.
8,864,521 B2 10/2014 Atkinson et al.
8,926,377 B2 1/2015 Kirk et al.
8,944,831 B2 2/2015 Stoner et al.
8,998,642 B2 4/2015 Manter et al.
9,004,942 B2 4/2015 Paniauqa
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,300,074 B2 3/2016 Gailus
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,559,467 B1 1/2017 Khorrami et al.
9,742,132 B1 * 8/2017 Hsueh ..... H01R 24/60
9,972,945 B1 5/2018 Huang et al.
10,079,449 B1 9/2018 Chien et al.
10,096,944 B2 10/2018 Huang et al.
10,122,129 B2 11/2018 Milbrand, Jr. et al.
10,236,605 B1 3/2019 Henry et al.
10,243,304 B2 3/2019 Kirk et al.
10,270,191 B1 4/2019 Li et al.
10,283,910 B1 5/2019 Chen et al.
10,348,040 B2 7/2019 Cartier, Jr. et al.
10,381,767 B1 8/2019 Milbrand, Jr. et al.
10,601,181 B2 3/2020 Lu et al.
10,777,921 B2 9/2020 Lu et al.
10,868,387 B2 12/2020 Hsiao et al.
10,886,649 B1 1/2021 Yang et al.
11,128,092 B2 9/2021 Yang et al.
11,146,025 B2 10/2021 Lu et al.
11,171,445 B1 11/2021 Shen et al.
11,189,971 B2 11/2021 Lu
11,289,850 B2 * 3/2022 Faith ..... H01R 13/506
11,303,065 B2 4/2022 Wang et al.
11,569,613 B2 1/2023 Lu
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0146926 A1 10/2002 Fogg et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0160399 A1 7/2006 Dawiedczyk et al.
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0170357 A1 7/2009 Yamashita et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0062650 A1 * 3/2010 Nakamura ..... H01R 13/64 439/65
2010/0081302 A1 4/2010 Atkinson et al.
2010/0203772 A1 8/2010 Mao et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0156938 A1 6/2012 Zhang
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0090001 A1 4/2013 Kagotani
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0111427 A1 4/2015 Foxconn
2015/0236451 A1 8/2015 Cartier, Jr. et al.
2015/0236452 A1 8/2015 Cartier, Jr. et al.
2015/0255926 A1 9/2015 Paniagua
2016/0149343 A1 5/2016 Atkinson et al.
2017/0352970 A1 12/2017 Liang et al.
2018/0062323 A1 3/2018 Kirk et al.
2018/0145438 A1 5/2018 Cohen
2018/0205177 A1 7/2018 Zhou et al.
2018/0212376 A1 7/2018 Wang et al.
2018/0219331 A1 8/2018 Cartier, Jr. et al.
2018/0269607 A1 9/2018 Wu et al.
2019/0052019 A1 2/2019 Huang et al.

(56) References Cited

U.S. PATENT DOCUMENTS

| | | | |
|---|---|---|---|
| 2019/0067854 | A1 | 2/2019 | Ju et al. |
| 2019/0140385 | A1 | 5/2019 | Huo et al. |
| 2019/0173209 | A1 | 6/2019 | Lu et al. |
| 2019/0173232 | A1* | 6/2019 | Lu ..... H01R 13/6594 |
| 2019/0267760 | A1 | 8/2019 | Chen |
| 2020/0076132 | A1 | 3/2020 | Yang et al. |
| 2020/0203867 | A1 | 6/2020 | Lu |
| 2020/0259294 | A1 | 8/2020 | Lu |
| 2020/0266584 | A1 | 8/2020 | Lu |
| 2020/0321727 | A1 | 10/2020 | Li et al. |
| 2020/0335914 | A1 | 10/2020 | Hsu et al. |
| 2020/0366019 | A1 | 11/2020 | Hsiao et al. |
| 2021/0075159 | A1 | 3/2021 | Wang et al. |
| 2021/0135404 | A1 | 5/2021 | Jiang |
| 2022/0037817 | A1 | 2/2022 | Lu et al. |
| 2022/0077632 | A1 | 3/2022 | Chen et al. |
| 2022/0115799 | A1 | 4/2022 | Tanaka et al. |
| 2022/0200208 | A1 | 6/2022 | Tseng et al. |
| 2022/0255261 | A1 | 8/2022 | Yang et al. |
| 2022/0336999 | A1 | 10/2022 | Lu |
| 2022/0360016 | A1 | 11/2022 | Lu et al. |
| 2022/0368077 | A1 | 11/2022 | Little |
| 2023/0013147 | A1 | 1/2023 | Lu |
| 2023/0052621 | A1 | 2/2023 | Little |

FOREIGN PATENT DOCUMENTS

| | | | |
|---|---|---|---|
| CN | 101176389 | A | 5/2008 |
| CN | 101600293 | A | 12/2009 |
| CN | 101790818 | A | 7/2010 |
| CN | 101120490 | B | 11/2010 |
| CN | 201846527 | U | 5/2011 |
| CN | 102239605 | A | 11/2011 |
| CN | 101600293 | B | 5/2012 |
| CN | 102598430 | A | 7/2012 |
| CN | 202395248 | U | 8/2012 |
| CN | 104409906 | A | 3/2015 |
| CN | 304240766 | S | 8/2017 |
| CN | 304245430 | S | 8/2017 |
| CN | 206712089 | U | 12/2017 |
| CN | 207677189 | U | 7/2018 |
| CN | 110729594 | A | 1/2020 |
| CN | 209963304 | U | 1/2020 |
| CN | 210111108 | U | 2/2020 |
| CN | 111196014 | A | 5/2020 |
| CN | 210723480 | U | 6/2020 |
| CN | 211655155 | U | 10/2020 |
| CN | 212571495 | U | 2/2021 |
| CN | 212968224 | U | 4/2021 |
| CN | 112952423 | A | 6/2021 |
| CN | 306646962 | S | 6/2021 |
| CN | 306646976 | S | 6/2021 |
| CN | 306647993 | S | 6/2021 |
| CN | 215184605 | U | 12/2021 |
| CN | 215299556 | U | 12/2021 |
| DE | 60216728 | T2 | 11/2007 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 1272347 | A | 4/1972 |
| JP | H07-302649 | A | 11/1995 |
| JP | 2001-510627 | A | 7/2001 |
| JP | 2006-344524 | A | 12/2006 |
| MX | 9907324 | A1 | 8/2000 |
| TW | 534482 | U | 5/2003 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M579828 | U | 6/2019 |
| TW | M583642 | U | 9/2019 |
| TW | M595343 | U | 5/2020 |
| TW | 202211556 | A | 3/2022 |
| TW | 202220301 | A | 5/2022 |
| TW | D223498 | S | 2/2023 |
| WO | WO 88/05218 | A1 | 7/1988 |
| WO | WO 98/35409 | A1 | 8/1998 |
| WO | 2004/059794 | A2 | 7/2004 |
| WO | WO 2004/059801 | A1 | 7/2004 |
| WO | WO2006/039277 | A1 | 4/2006 |
| WO | WO 2007/005597 | A2 | 1/2007 |
| WO | WO 2007/005599 | | 1/2007 |
| WO | WO 2008/124057 | A2 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

International Search Report and Written Opinion for International Application No. PCT/CN2017/108344 dated Aug. 1, 2018.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Preliminary Report on Patentability for International Application No. PCT/US2010/056482 dated May 24, 201.
International Search Report and Written Opinion for International Application No. PCT/US2010/056482 dated Mar. 14, 2011.
International Preliminary Report on Patentability for International Application No. PCT/US2011/026139 dated Sep. 7, 2012.
International Search Report and Written Opinion for International Application No. PCT/US2011/026139 dated Nov. 22, 2011.
International Search Report and Written Opinion for International Application No. PCT/US2011/034747 dated Jul. 28, 2011.
International Preliminary Report on Patentability for International Application No. PCT/US2012/023689 dated Aug. 15, 2013.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], SFF-TA-1016 Specification for Internal Unshielded High Speed Connector System. Rev 0.0.1. SNIA SFF TWG Technology Affiliate. Nov. 15, 2019. 40 pages.
Beaman, High Performance Mainframe Computer Cables. 1997 Electronic Components and Technology Conference. 1997;911-7.
Lu, Electrical Connector Having Symmetrical Docking Holes, U.S. Appl. No. 17/365,465, filed Jul. 1, 2021.
Shi et al. Improving Signal Integrity in Circuit Boards by Incorporating Absorbing Materials. 2001 Proceedings. 51st Electronic Components and Technology Conference, Orlando FL. 2001:1451-56.
U.S. Appl. No. 17/365,465, filed Jul. 1, 2021, Lu.
U.S. Appl. No. 17/386,203, filed Jul. 27, 2021, Lu.
EP 11166820.8, Jan. 24, 2012, Extended European Search Report.
PCT/CN2017/108344, Aug. 1, 2018, International Search Report and Written Opinion.
PCT/US2005/034605, Jan. 26, 2006, International Search Report and Written Opinion.
PCT/US2006/025562, Oct. 31, 2007, International Search Report with Written Opinion.

(56) References Cited

OTHER PUBLICATIONS

PCT/US2010/056482, May 24, 2012, International Preliminary Report on Patentability.
Lu, Electrical Connector Having Symmetrical Docking Holes, U.S. Appl. No. 18/147,410, filed Dec. 28, 2022.
Taiwanese Office Action dated Mar. 29, 2023 in connection with Taiwanese Application No. 110121960.

* cited by examiner

COMPACT ELECTRICAL CONNECTOR WITH SHELL BOUNDING SPACES FOR RECEIVING MATING PROTRUSIONS

CROSS-REFERENCE TO RELATED APPLICATIONS

The present application claims the benefit of priority of U.S. Provisional Application No. 63/040,422 filed Jun. 17, 2020, entitled "COMPACT ELECTRICAL CONNECTOR", the entire contents of which is incorporated by reference herein.

FIELD OF THE INVENTION

This disclosure relates generally to electrical interconnection systems and more specifically to compact electrical connectors.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signal transmission to transfer information (e.g., data, commands, and/or other electrical signals) often utilize electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated on one or both ends with a plug type of electrical connector ("plug connector" herein). A PCB may be equipped with a receptacle type of electrical connector ("receptacle connector" herein) into which the plug connector may be inserted to connect the cable to the PCB. A similar arrangement may be used at the other end of the cable, to connect the cable to another PCB, so that signals may pass between the PCBs via the cable.

SUMMARY

According to an aspect of the present technology, an electrical connector is provided. The connector may include: a housing comprised of a bottom and a wall bounding, at least in part, an opening adjacent the bottom; an island protruding from the bottom of the housing and into the opening; a plurality of terminals supported by the island; and a shell configured to encircle an outer surface of the wall. The shell may be comprised of: a plurality of first portions configured to conform with the outer surface of the wall, a plurality of second portions spaced apart from the outer surface of the wall, and a plurality of hook portions engaged with an edge of the wall.

In some embodiments, the wall of the housing may have first and second longer sections connected to first and second shorter sections. At least one of the first portions of the shell and at least one of the second portions of the shell may be located along the first longer section of the wall. At least one of the first portions of the shell and at least one of the second portions of the shell may be located along the second longer section of the wall. In one example, a number of the at least one of the first portions of the shell located along the first longer section of the wall may be different from a number of the at least one of the second portions of the shell located along the first longer section of the wall. In another example, a number of the at least one of the first portions of the shell located along the second longer section of the wall may be different from a number of the at least one of the second portions of the shell located along the second longer section of the wall.

In some embodiments, the outer surface of the wall and the plurality of second portions of the shell may form a plurality of spaces configured to receive a plurality of plug portions of a mating connector therein when the mating connector is in a mating position with the electrical connector. The plurality of spaces may be arranged such that the electrical connector may have a single mating position with the mating connector. For example, the electrical connector may be a receptacle connector, and the mating connector may be a plug connector. In one example, the plurality of spaces may include: a first space located along the first longer section of the wall, the first space having a length greater than about half a length of the first longer section in a second direction, and a plurality of second spaces located along the second longer section of the wall, each of the second spaces having a length less than about a quarter of a length of the second longer section in the second direction. The first space may be configured to receive a bar-shaped portion of the mating connector, and each of the second spaces may configured to receive a leg of the mating connector.

In some embodiments, a maximum height of the shell in a first direction may be greater than a maximum height of the wall in the first direction. In one example, the wall of the housing may have first and second longer sections connected to first and second shorter sections at four corners. The shell may have four corners configured to conform with the four corners of the wall. The maximum height of the shell may be at two of the four corners. The shell may be comprised of a plurality of legs extending in the first direction and configured to engage with a printed circuit board (PCB).

In some embodiments, an edge of the wall may include a plurality of notches configured to engage with the plurality of hook portions of the shell.

According to an aspect of the present technology, an electrical connector is provided. The connector may include: an insulative housing comprising a bottom and a wall extending from the bottom at a periphery of the bottom, the wall comprising first and second longer wall portions and first and second shorter wall portions and bounding a cavity. A plurality of electrical terminals may be supported by the insulative housing with mating portions exposed within the cavity. A shell may encircle an outer surface of the wall, and may comprise a first and second longer shell portions and first and second shorter shell portions. The first longer shell portion may be adjacent the first longer wall portion and may have first and second guide portions extending beyond the first longer wall. The second longer shell portion may be adjacent the second longer wall portion. The shell may have a projection engaged with the second longer wall.

In some embodiments, the shell comprises a first portion configured to conform with the outer surface of the wall, and a plurality of second portions spaced apart from the outer surface of the wall. Each of the second portions of the shell bounds a space between the outer surface of the wall, and each of the spaces is configured to receive a portion of a mating connector therein.

In some example configurations, at least one of the spaces may be located along each of the first and second longer wall portions; and the first portion of the shell may conform with the outer surface of the wall at the first and second shorter wall portions. In some example configurations, the spaces may be arranged such that the electrical connector may have a single mating position with the mating connector. In some example configurations, the spaces may include: a first space located along the first longer wall portion and having a length greater than about half a length of the first longer wall portion in a length direction, and a plurality of second spaces located along the second longer wall portion. Each of the second spaces may have a length less than about a quarter of a length of the second longer wall portion in the length direction.

In some embodiments the projection comprises a hook, hooked over an edge of the second longer wall.

In some embodiments, the first shorter shell portion comprises a third guide portion extending above the first shorter wall portion; and the second shorter shell portion comprises a fourth guide portion extending above the second shorter wall portion.

In some embodiments, the wall has an upper edge. The third guide portion is attached to the first guide portion, the fourth guide portion is attached to the second guide portion; and the first and second guide portions are separated by segments of the shell having edges aligned with the upper edge of the wall. The third and fourth guide portions are separated by segments of the shell having edges aligned with the upper edge of the wall.

In some embodiments, the wall of the housing may have four corners, the shell may have four corners configured to conform with the four corners of the wall, and the maximum height of the shell may be at two of the four corners.

In some embodiments, an edge of the second longer wall comprises a notch and the projection extends into the notch such that the projection engages with the second longer wall at the notch.

According to some aspects of the present technology, a method of mating a plug connector and a receptacle connector comprising an insulative housing and a shell is provided. The method may comprise aligning the plug connector with the receptacle connector by: positioning the plug connector with guide portions of the shell; engaging a bar extending from the plug connector with a first space located between a shell of the receptacle connector and a housing wall of the receptacle connector, engaging a plurality of legs extending from the plug connector with a plurality of second spaces located between the shell of the receptacle connector and the housing wall of the receptacle connector, and engaging a cavity of the plug connector with an island protruding from a housing bottom of the receptacle connector. The method may further comprise, after the aligning, pressing the plug connector towards the receptacle connector. The first space may be located along a first long side of the receptacle connector. The second spaces may be located along a second long side of the receptacle connector. The island may support a plurality of electrical receptacle terminals exposed on an outer surface of the island. A plurality of electrical plug terminals may be exposed on a surface of the cavity and may be configured to engage with the receptacle terminals when the plug connector and the receptacle connector are in a mated position. The mated position may be a single position in which the plug connector aligns with the receptacle connector.

In some embodiments of this aspect, the pressing of the plug connector towards the receptacle connector may be in a direction orthogonal to a housing bottom of the receptacle connector and orthogonal to a cavity bottom of the plug connector.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

Figure 1B:
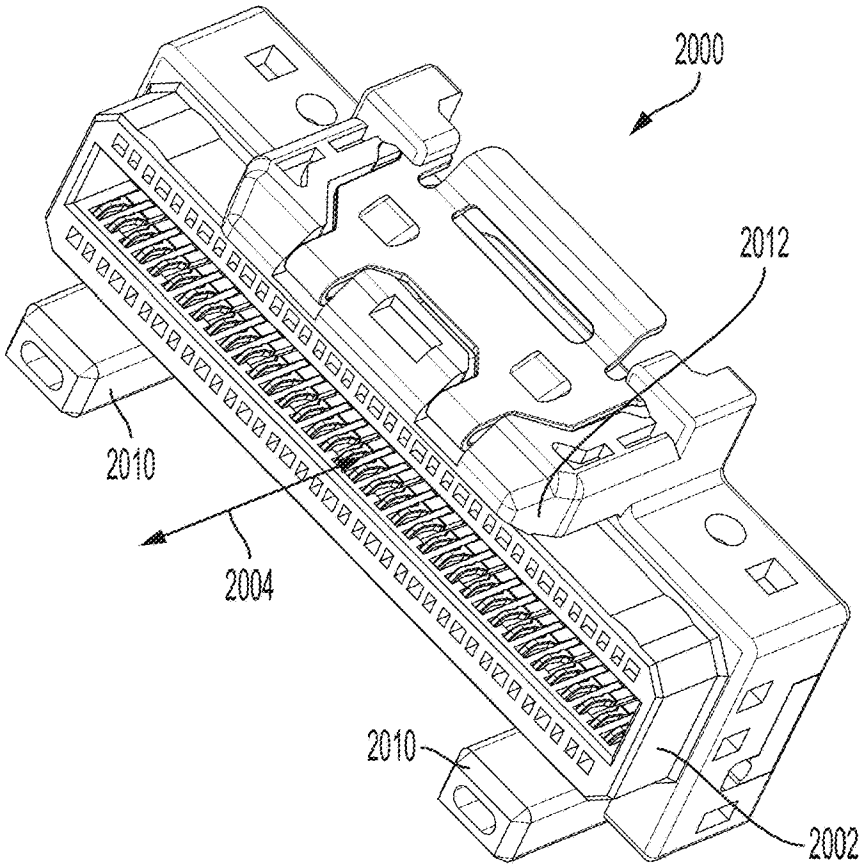
FIG. 1B is a bottom perspective view of a plug connector, according to some embodiments of the present technology.

The inventors have recognized and appreciated design techniques for electrical connectors that enable mated plug and receptacle connectors to occupy a small volume while providing reliable operation for high-integrity signal interconnects. Techniques and technology described herein may lead to compact yet robust connectors, which are less likely to be damaged during mating, enabling high performance and compact electronic devices.

The inventors have further recognized and appreciated that, miniaturized electrical connectors are more likely to be damages by some forces than other forces that can arise during use as the receptacle connector is mated with another connector (e.g., a plug connector). Although it may be preferred that, during mating of the plug and receptacle connectors, force be applied in a direction parallel to an axial direction of the receptacle connector, in practice, however, a user may not pay special attention to an angle at which the plug connector is oriented with respect to the receptacle connector. Thus, the receptacle connector may be subject to an external force that is not parallel to the axial direction of the receptacle connector. Such off-axis forces can impact the receptacle connector in ways that impact the integrity of signals passing through the receptacle connector. Off-axis forces, for example, may cause the receptacle connector to tilt. In some situations, the force may be sufficient to break solder joints connecting the metal terminals to a PCB. In other scenarios, the off-axis forces may deform the terminals, shift their positions, or otherwise alter the signal paths through the connector in ways that degrade the integrity of signals passing through the connector.

Damage may also result if the user attempts to press the plug into the connector with the wrong orientation or with the plug misaligned with receptacle. For example, when a user attempts to insert a misaligned plug connector, the receptacle connector may be subject to a large force, such 55 N or more. In addition to the damage to the solder connections of the metal terminals, the force may be sufficient to deform or break one or more portions of an insulative housing of the receptacle connector, including a portion bounding a receiving portion. The receptacle connector may then cease to be able to hold the plug connector reliably, thus creating the possibility of intermittent disconnection between the plug and receptacle connectors. Consequently, the receptacle connector may lose its functionality and, in turn, normal operation of the electronic device employing the receptacle connector may cease.

These risks of damage are greater for miniaturized connectors, such as those with terminals spaced, center to center, at 0.6 mm or less, such as connectors with terminal spacing of 0.5 mm or less, 0.4 mm or less or 0.35 mm or less.

Aspects of the techniques and technology described herein may reduce or eliminate the possibility of improper orientation of a plug connector during a mating operation with a receptacle connector. Aspects of the techniques and technology described herein may reduce or eliminate the possibility of misalignment between the plug and receptacle connectors. Aspects of the techniques and technology described herein may minimize or eliminate the application of damaging forces during a mating operation.

Figure 1A:
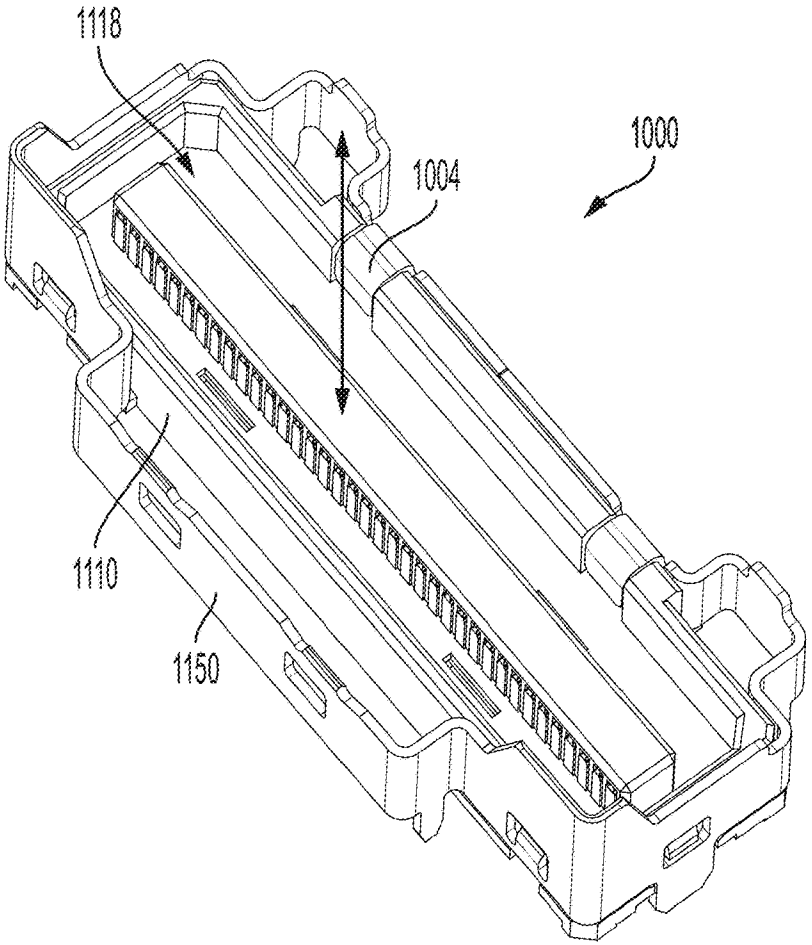
FIG. 1A is a top perspective view of a receptacle connector, according to some embodiments of the present technology.

Turning now to the figures, FIG. 1A depicts an example of a receptacle connector 1000 configured to mate with a plug connector 2000 (FIG. 1B).

Once mated, receptacle connector 1000 and plug connector 2000 depicted in FIGS. 1A and 1B provides a low-profile connection between a printed circuit board (not shown) to which receptacle connector 1000 may be attached and multiple cables (not shown), which may extend from plug connector 2000. In the embodiment illustrated, the cable may extend perpendicular to an engagement direction of receptacle connector 1000 and plug connector 2000. In this regard, the plug connector 2000 may be considered a right-angle plug connector 200. Direction 1004 in FIG. 1A shows the engagement and disengagement directions of the mated pair of connectors, and may be considered an axial direction of the receptacle connector 1000. In the engaged or mated state, the mated pair may have a low profile, close to a mounting surface of a circuit board on which the receptacle connector 1000 may be mounted. Low profile, for example, may be less than 15 mm, in some embodiments, or less than or equal to 10 mm or less than or equal to 5 mm, for example.

As will be appreciated, the receptacle connector 1000 may engage with a different type of plug connector when a low profile is not necessary or desired. For example, the receptacle connector 1000 may engage with a plug connector in which cables extend parallel to the engagement direction.

In the example of FIGS. 1A and 1B, receptacle connector 1000 has a cavity 1118 configured to receive a mating portion 2002 of plug connector 2000. With plug connector 2000 properly mated with receptacle connector 1000, terminals, such as terminals 1122 (FIG. 2A), within cavity 1118 will mate with corresponding terminals in plug connector 2000 enabling signals to pass through the mated connectors.

Mating of plug connector 2000 with receptacle connector 1000 may be achieved by moving mating portion 2002 of plug connector 2000 in direction 1004 into cavity 1118 of receptacle connector 1000. Proper mating may be achieved by aligning plug connector 2000 with receptacle connector 1000 such that direction 2004 is coincident with direction 1004. Both direction 2004 and 1004 will be perpendicular to a surface of a printed circuit board to which receptacle connector 1000 is attached. Further, features of plug connector 2000 that receive features of receptacle connector 1000, and vice versa, will be aligned along the direction 1004 and 2004, such that relative motion of the connector in direction 1004 and 2004 brings these features into engagement. As described in greater detail below, plug connector 2000 and receptacle connector 1000 may provide features that both align the connectors for engagement by relative motion in direction 1004 and 2004 and resists damage from force that is not aligned with directions 1004 and 2004.

In FIG. 1A, the receptacle connector 1000 is depicted in a top perspective view, showing surfaces and structures that come into contact with the plug connector 2000 when the plug connector 2000 is in a mated position with the receptacle connector 1000. Similarly, in FIG. 1B, the plug connector 2000 is shown in a bottom perspective view, showing surfaces and structures that come into contact with the receptacle connector 1000 when in the mated position.

Figure 2B:
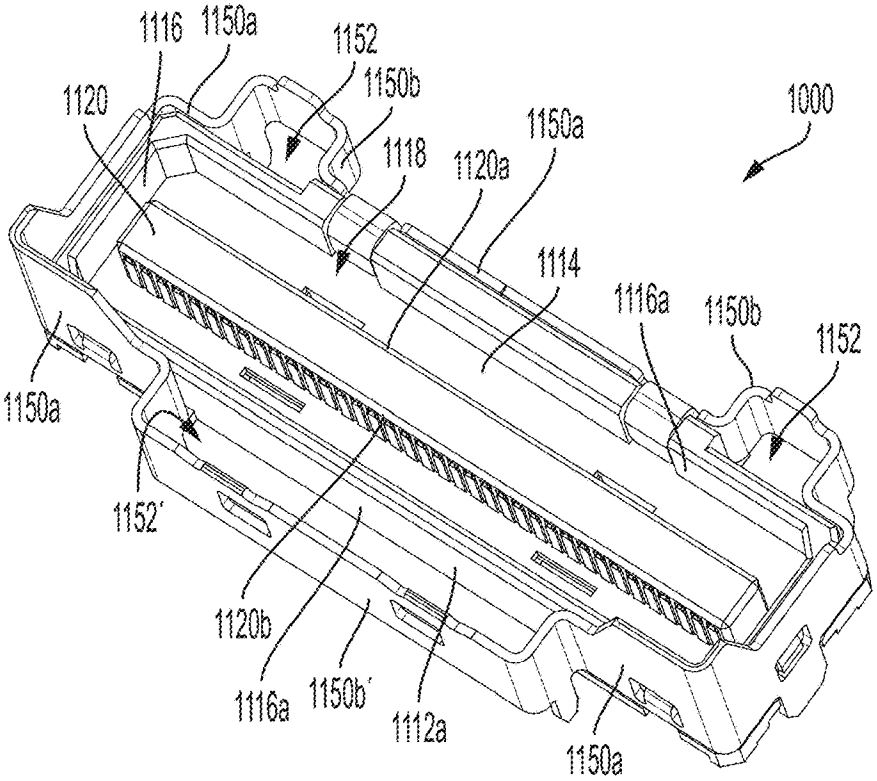
FIG. 2B is a rear top perspective view of the receptacle connector of FIG. 2A.
Figure 2A:
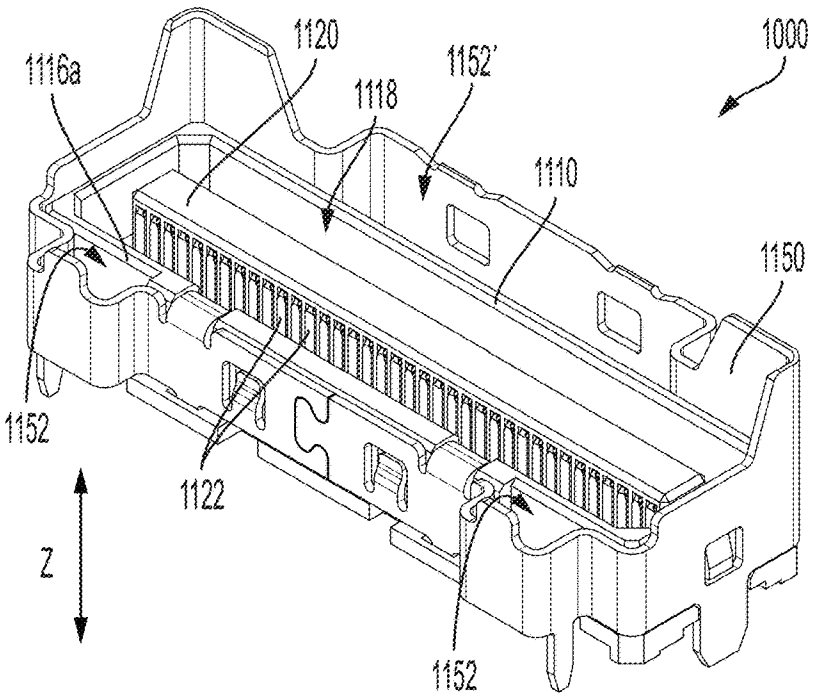
FIG. 2A is a front top perspective view of a receptacle connector, according to some embodiments of the present technology.
Figure 2C:
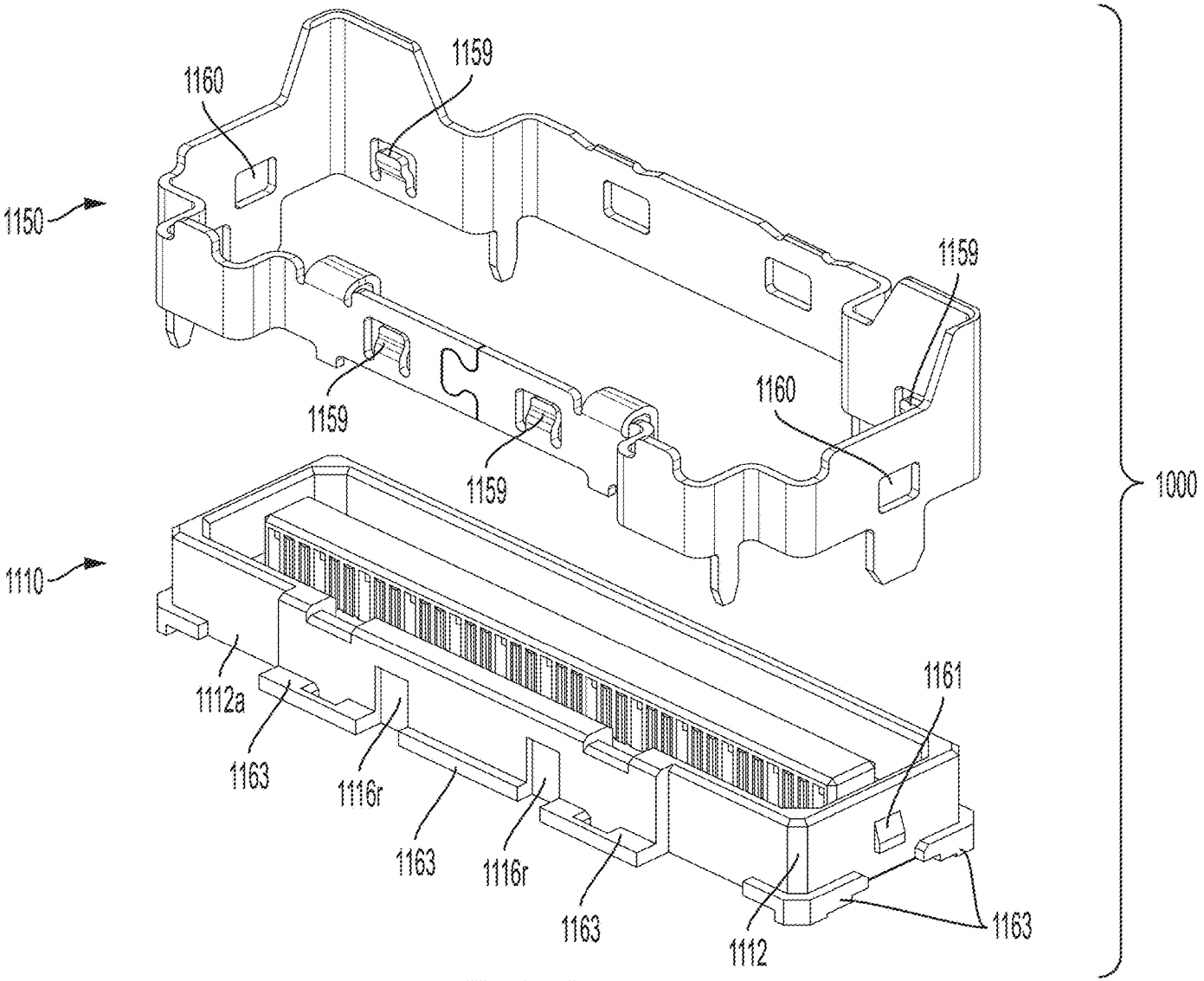
FIG. 2C is top perspective view the receptacle connector of FIG. 2A in a first disassembled state.
Figure 2D:
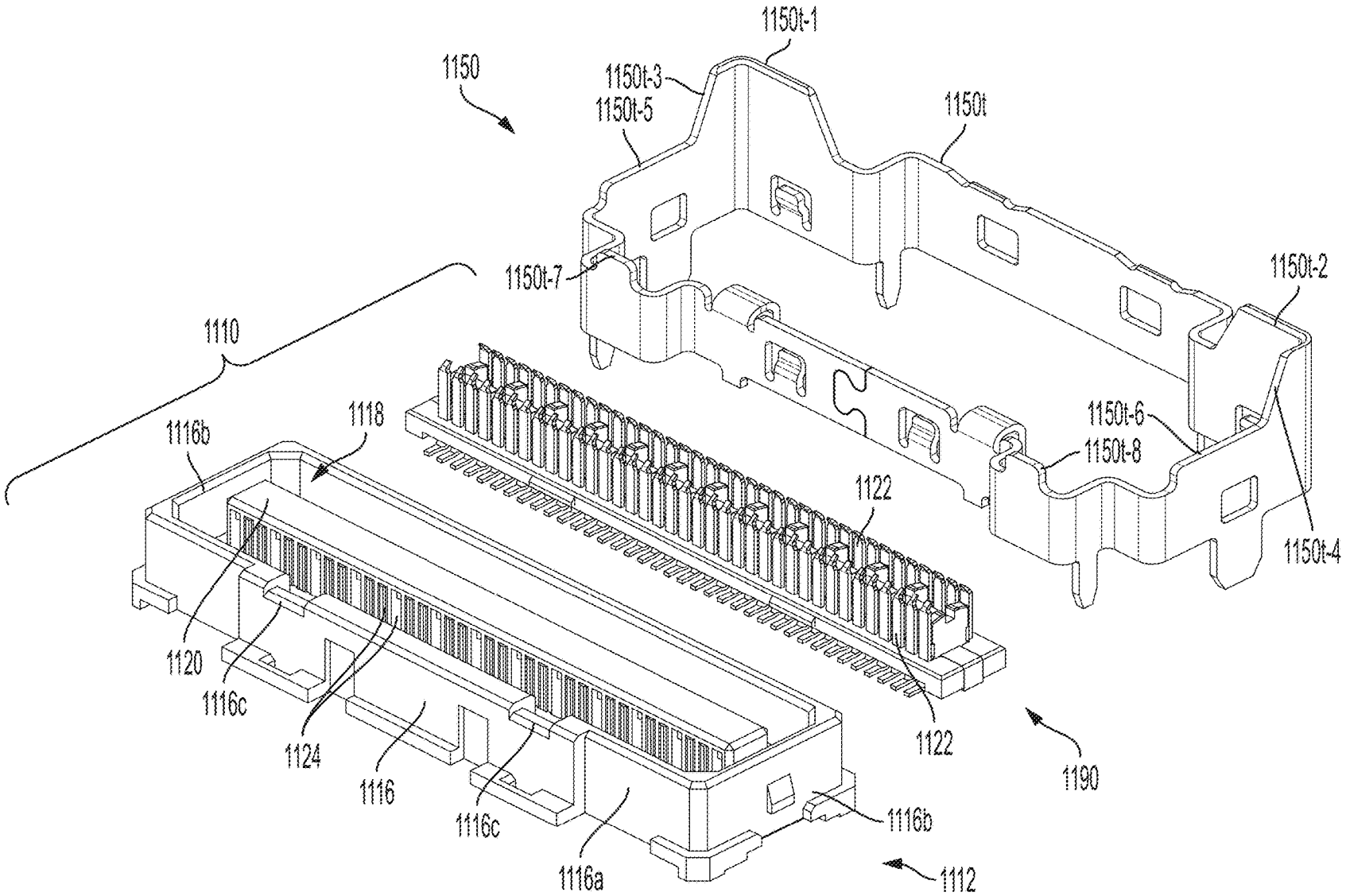
FIG. 2D is a top perspective view the receptacle connector of FIG. 2C in a second disassembled state.
Figure 2E:
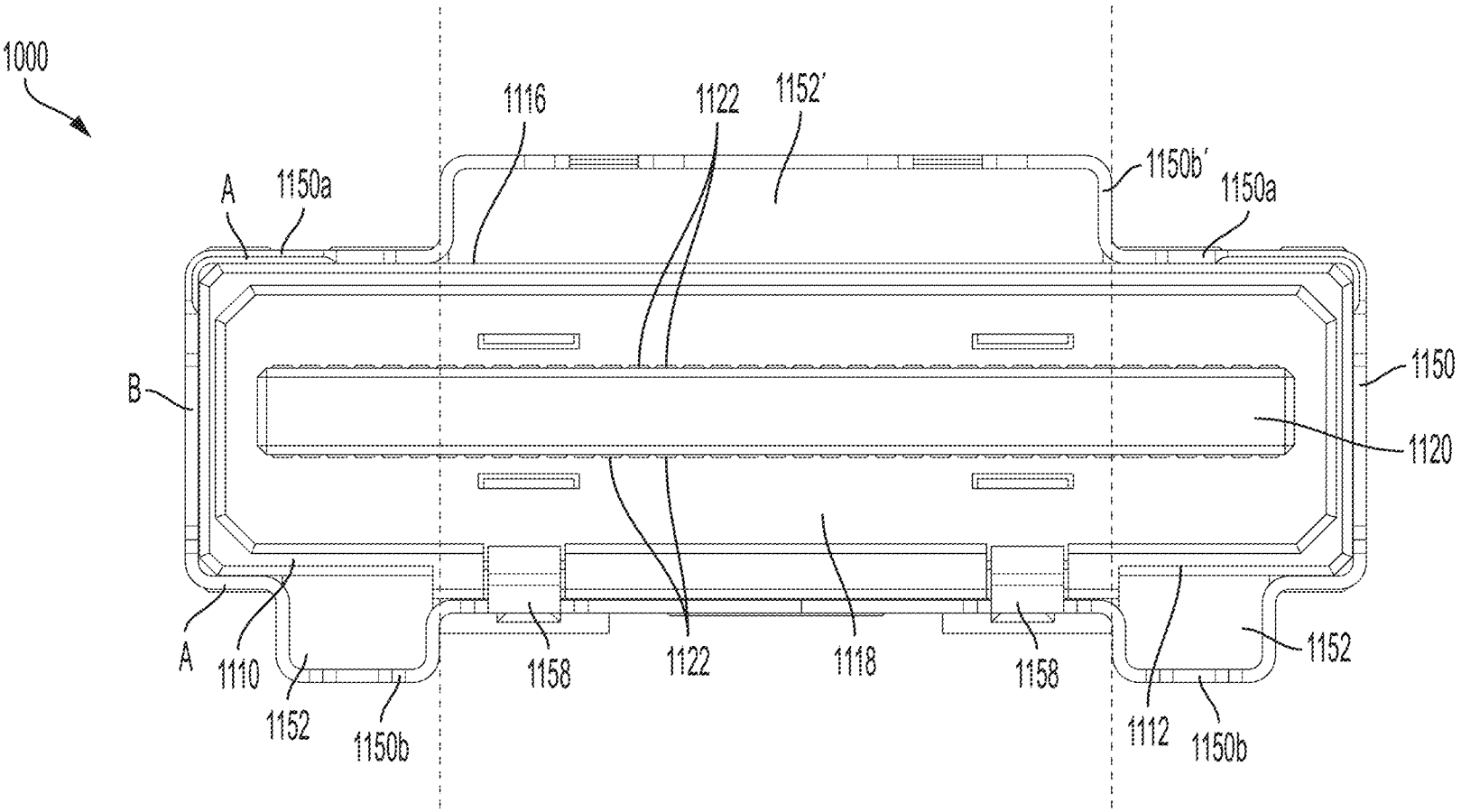
FIG. 2E is a top plan view of the receptacle connector of FIG. 2A.

FIG. 2A depicts the receptacle connector 1000 in front top perspective view, and FIG. 2B depicts the receptacle connector 1000 in rear top perspective view. FIGS. 2C and 2D depict the receptacle connector 1000 in disassembled states. FIG. 2E depicts a top plan view of the receptacle connector 1000.

The receptacle connector may include a housing assembly 1110 and a shell 1150. The housing assembly 1110 may include an insulative housing 1112 having a bottom 1114 and a wall 1116 extending from a periphery of the bottom 1114.

The bottom 1114 and the wall 1116 may define a cavity 1118 of the housing 1112. For example, the wall 1116 may extend perpendicularly from the bottom 1114 of the housing 1112. The bottom 1114 may have a generally rectangular shape, such that the wall 1116 may have two longer sides 1116*a* and two shorter sides 1116*b*. The housing assembly 1110 may further include a terminal assembly 1190.

An island 1120 may extend from the bottom 1114 into the cavity 1118 of the housing 1112. The island 1120 may have a hollow interior and may be structured to accommodate the terminal assembly 1190 in the hollow interior. The terminal assembly 1190 may include a plurality of elongate terminals 1122 that may include ground terminals and signal terminals. The island 1120 may include two major surfaces 1120*a* respectively facing the two longer sides 1116*a* of the wall 1116. One or both of the major surfaces 1120*a* may include channels or slots 1124 through which portions of the terminals 1122 may be exposed.

An upper edge of the wall 1116 may include notched portions 1116*c*, which may engage with the shell 1150, as describe below. The notched portions 1116*c* may be located on one or both of the two longer sides 1116*a* of the wall 1116.

As shown in FIG. 2B, the cavity 1118 of the housing 1112 may have a longer dimension parallel to the longer side 1116*a* of the wall 1116, and a shorter dimension orthogonal to the longer dimension and parallel to the shorter side 1116*b* of the wall 1116. The island 1120 may be elongate along the longer dimension of the cavity 1118 of the housing 1112. Optionally, guide posts (not shown) may extend from the bottom 1114 of the housing 1112 and may be configured to engaged with openings or recesses (not shown) in the plug connector 2000. For example, the guide posts may be disposed in the housing 1112 at or near diagonally opposite corners of the housing 1112, respectively between diagonally opposite corners of the island 1120 and diagonally opposite corners of the wall 1116.

The shell 1150 of the receptacle connector 1000 may be configured to encircle or surround an outer surface 1112*a* of the housing 1112. In the illustrated embodiment, shell 1150 is stamped from a sheet of metal that is formed into the pictured shape. The ends of that strip of metal are joined, such as by welding or brazing or via a mechanical attachment. In the illustrated embodiment, shell 1150 fully encircles the housing 1112, with portions of the shell adjacent all walls of the housing. In other embodiments, shell 1150 may have portions adjacent only some of the walls of housing 1112 or only a portion of one or more walls.

As shown in FIG. 2C, the housing 1112 may include ledge portions 1163 extending laterally from a lower edge of the housing 1112. The ledge portions 1163 may serve as supports on top of which the shell 1150 sits when the housing 1112 and the shell 1150 are assembled together. The ledge portions 1163 also may serve as stops to prevent the shell 1150 from being pushed beyond a predetermined optimal position during a process of placing the shell 1150 around the housing 1112.

Figure 3B:
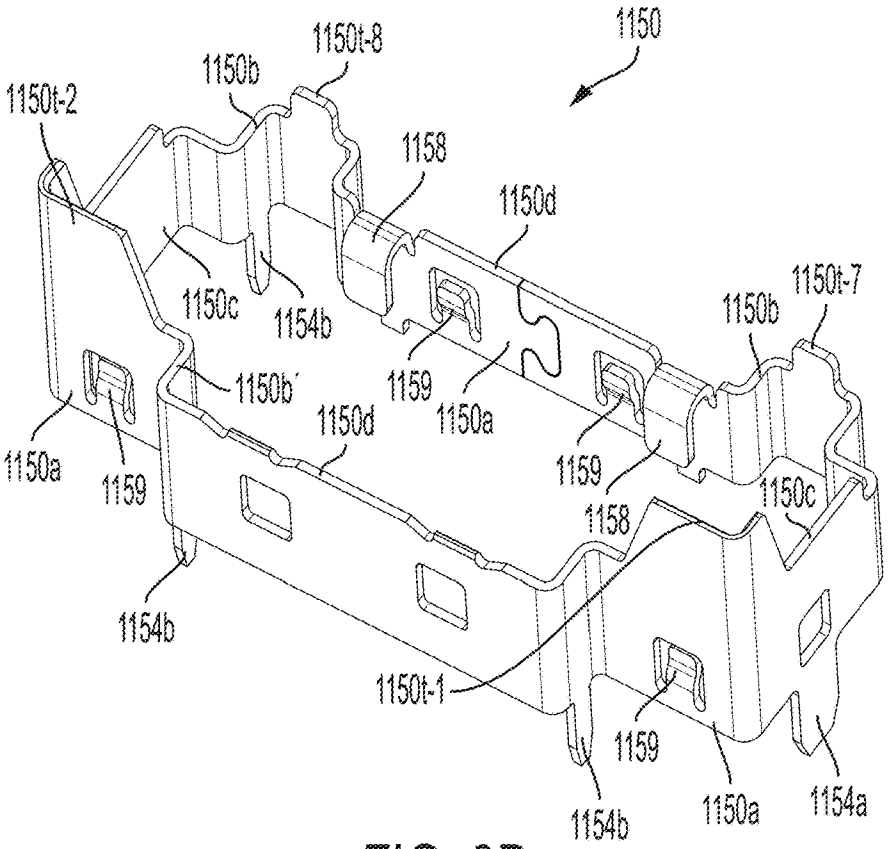
FIG. 3B is a rear top perspective view of the shell of FIG. 3A.
Figure 3A:
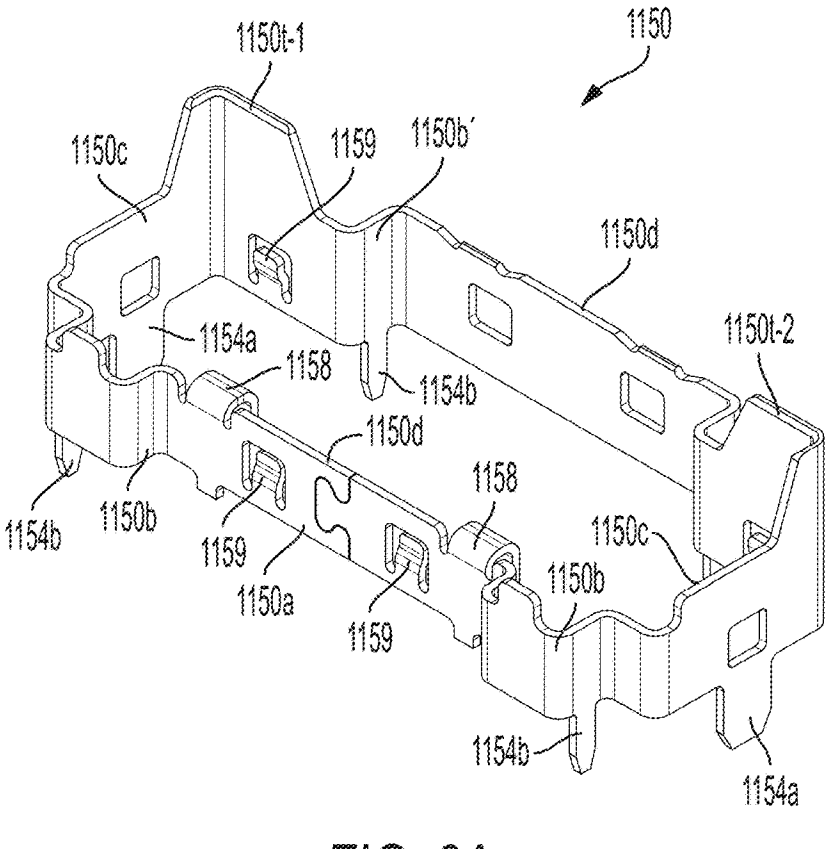
FIG. 3A is a front top perspective view of a shell of a receptacle connector, according to some embodiments of the present technology.
Figure 3C:
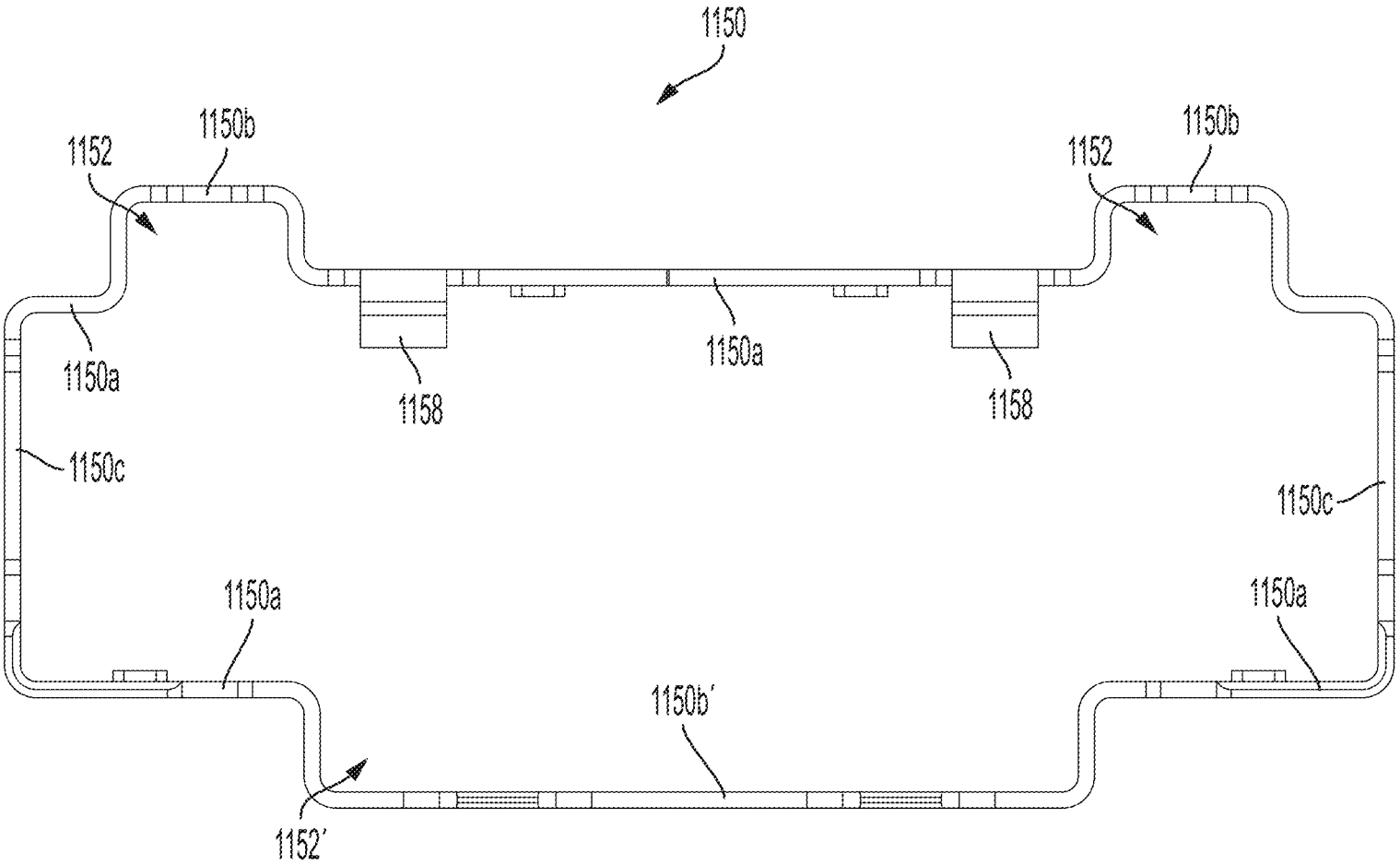
FIG. 3C is a top plan view of the shell of FIG. 3A.

FIGS. 3A, 3B, 3C depict a top front perspective view, a top rear perspective view, and a top plan view of the shell 1150, respectively. The shell 1150 may include at least one conforming portion 1150*a*, which conforms with and is adjacent the outer surface 1112*a* of the housing 1112. The shell 1150 may include at least one spaced-apart portion 1150*b*, 1150*b*', each of which may be separated or spaced apart from the outer surface 1112*a* of the housing 1112 to define a space 1152, 1152' therebetween. In an embodiment of the present technology, at least some of the conforming portions 1150*a* of the shell 1150 have a snug fit with the housing 1112 when the housing 1112 and the shell 1150 are assembled together. For example, at regions A and B in FIG. 2E, there may be no gap between the housing 1112 and the shell 1150.

In an embodiment of the present technology, the shell 1150 may have a spaced-apart portion 1150*b*' on one side and at least one spaced-apart portion 1150*b* on an opposite side, and the spaced-apart portions may be arranged such that no spaced apart portion on one side of the shell 1150 is directly opposite another spaced apart portion on the opposite side of the shell. This is schematically depicted by the dashed lines in FIG. 2E showing that no region of the spaced-part portion 1150*b*' is not directly opposite any region of the spaced-apart portions 1150*b* on the opposite side of the shell 1150. Such a structure may facilitate a "blind" mating operation, where a user may not be able to see one or both of the connectors 1000, 2000 when mating the connectors 1000, 2000 together, and by letting the user know that there is a misalignment before the user uses any force to push the connectors 1000, 2000 together. Optionally, the spaced-apart portions 1150*b*, 1150*b*' may be structured such that a total length of all of the spaced-apart portions 1150*b*, 1150*b*' summed together is within 20% or even within 10% of a length of a long side of the housing 1112. FIGS. 3A, 3B, 3C depict the shell 1150 to include two symmetrically arranged spaced-apart portions 1150*b* on one long side 1150*d* of the shell 1150, and one centrally arranged spaced apart portion on another long side 1150*d* of the shell 1150. It should be understood, however, that in various other embodiments of the present technology the shell 1150 may have more than two spaced-apart portions on both long sides 1150*d* of the shell 1150, which need not be symmetrically arranged, and/or may be one spaced apart portion(s) on one or both short sides 1150*c* of the shell 1150, or one non-centrally arranged spaced apart portion on one or both of the long sides 1150*d* of the shell 1150.

In the illustrated embodiment, a mating plug connector may have features that, during mating of the plug and receptacle connectors, fit within the spaces 1152, 1152'. These features may extend past mating portion 2002, in direction 2004, such that they fit within spaces 1152, 1152' before the connectors are mated. Engagement of these features may align direction 2004 (FIG. 1B) relative to the plug connector 2000 with direction 1004 (FIG. 1A) relative to the receptacle connector, which may guide a user, in applying a force to urge the plug connector towards the receptacle connector, to apply a force perpendicular to a substrate to which the receptacle connector is mounted, thereby reducing the risk of damage during mating that can interfere with the integrity of signals passed through the mated connectors.

Figure 4B:
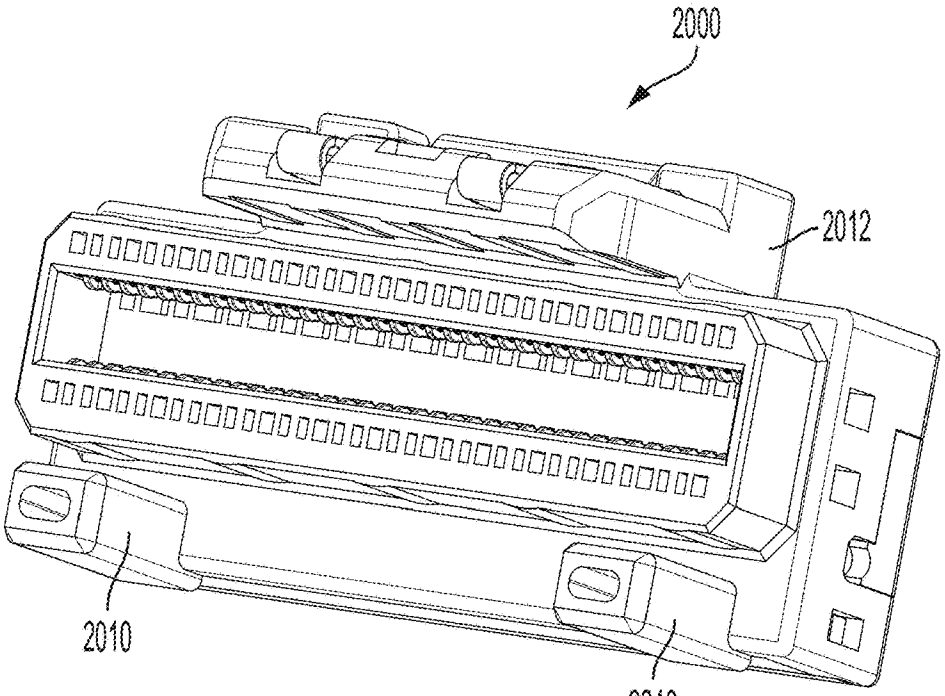
FIG. 4B is a bottom perspective view of the plug connector of FIG. 4A.
Figure 4A:
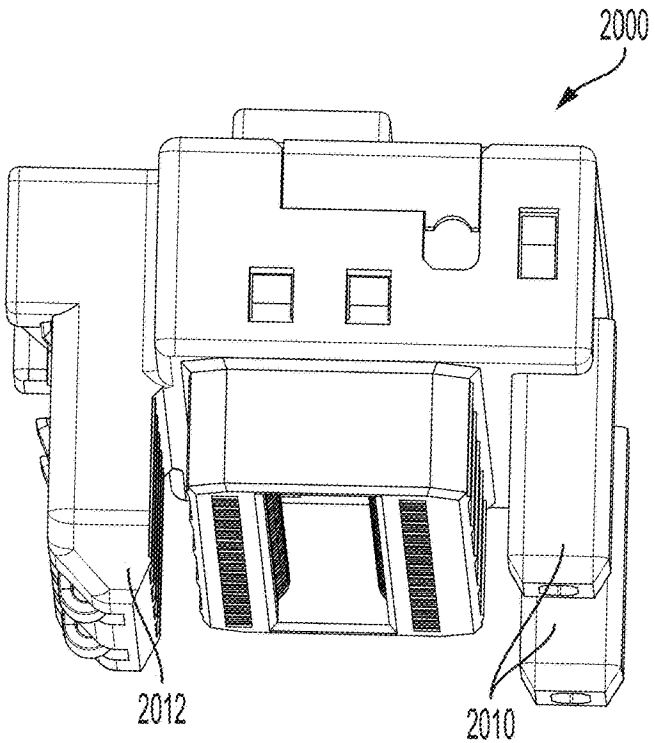
FIG. 4A is a perspective view of a side of a plug connector, according to some embodiments of the present technology.

More specifically, the spaces 1152, 1152' defined by the spaced-apart portions 1150*b*, 1150*b*' of the shell 1150 may be structured to receive protrusions of the plug connector 2000. For example, the spaces 1152 may be configured to receive legs 2010 of the plug connector 2000 therein; and the space 1152' may be configured to receive a bar-shaped member 2012 of the plug connector 2000 therein, as depicted in FIGS. 1B, 4A, and 4B. The spaced apart portions 1150*b*, 1150*b*' enable a user to align the plug connector 2000 properly with the receptacle connector 1000 before using force to mate the two connectors 1000, 2000 together. That is, the user may use the spaced apart portions 1150*b*, 1150*b*' of the receptacle connector 1000 and the legs 2010 and the bar-shaped member 2012 of the plug connector 2000 to achieve a general alignment during an initial part of a mating operation. Once alignment is achieved, the user may be confident that force used to push the two connectors 1000, 2000 together into a final mated position will not damage either of the two connectors 1000, 2000.

The conforming portion 1150*a* of the shell 1150 may include the two shorter sides 1150*c* adjacent the two shorter sides 1116*b* of the wall 1116, and may include portions of the two longer sides 1150*d* adjacent to the two longer sides 1116*a* of the wall 1116. That is, the conforming portion 1150*a* may include multiple conforming segments, which may conform with portions of the outer surface 1112*a* of the housing 1112 except at the spaced-apart portions 1150*b*, which may be disposed along one or both of the two longer sides 1150*d* of the shell 1150. Optionally, the spaced-apart portions 1150*b* may be disposed along one or both of the two shorter sides 1150*c* of the shell 1150, or along any combination of the two longer sides 1150*d* and the two shorter sides 1150*c*.

A projection tab 1154*a* may extend from each of the two shorter sides 1150*c* of the shell 1150. The projection tabs 1154*a* may extend in an axial direction Z of the receptacle connector 1000. Similarly, legs 1154*b* may extend from the spaced-apart portions 1150*b*, 1150*b*' in the axial direction Z of the receptacle connector 1000. The projection tabs 1154*a* and the legs 1154*b* may be configured to connect with or be attached to a PCB board (not shown) on which the receptacle connector 1000 is to be mounted. The projection tabs 1154*a* and the legs 1154*b* may, for example, fit within holes of the PCB. They may be soldered to be retained within those holes, and may also position the entire receptacle connector with respect to a PCB such that the connector can be properly positioned. After the receptacle connector is attached to the PCB, projection tabs 1154*a* and the legs 1154*b* may provide mechanical support for the receptacle connector. In some embodiments, at least one leg 1154*b* may extend from each of the spaced apart portions 1150*b*, and at least two legs 1154*b* may extend for the spaced apart portion 1150*b*'.

In the illustrated embodiment, the shell 1150 includes guides in two of the four corners of the shell. As can be seen in FIG. 2A, a portion of shell 1150 has an upper edge aligned with an upper edge of wall 1116, whereas the guides, including guide portions 1150*t*-1 and 1150*t*-2 extend above the upper edge of wall 1116. In this example, each of the guides has a portion extending from a portion of the shell 1150 adjacent one of the longer walls, and also has a portion 1150*t*-3 and 1150*t*-4 extending from a portion of the shell 1150 adjacent one of the shorter walls. Those extending portions are joined, forming a right-angle corner. These guides may aid in aligning the plug relative to the receptacle. For example, a user may move the plug 2000 towards the guide portions 1150*t*-1 and 1150*t*-2. When the plug 2000 engages with the guides, the plug 2000 may be aligned such that the legs 2010 and the bar-shaped member 2012 are aligned with respective spaced apart portions 1150*b*, 1150*b*' of the receptacle connector 1000. In this way, the user may be guided so as not to apply a downward force until the connectors are in a position that the downward force is unlikely to damage either of the connectors.

Aligning the connector via guide portions 1150*t*-1 and 1150*t*-2 may result in a force on the guides that is transverse to the insertion direction. To ensure the receptacle connector 1000 stays mechanically intact, shell 1150 may be secured to the insulative housing of the receptacle connector in locations that will resist separation of the shell and insulative housing despite force applied to guides 1150*t*-1 and 1150*t*-2.

As shown in FIG. 2D, the shell 1150 may include a first and second guide portions 1150*t*-1 and 1150*t*-2, which here are at each end of a long wall of the housing. Each of the guide portions 1150*t*-1 and 1150*t*-2 extends above the housing. The shell may also include third guide portion 1150*t*-3 and a fourth guide portion 1150*t*-4, each of which also extends above the upper edge of the wall 1116 of the housing 1112. The first and third guide portions 1150*t*-1,1150*t*-3 may join together to form a corner. The third guide portion 1150*t*-3 may have a sloping upper edge that has a first end connected to an upper edge of the first guide portion 1150*t*-1 and a second end connected to guide portion 1150*t*-5 Fourth guide portion 1150*t*-4 may be shaped similarly to the third guide portion, and may connect to the second guide portions 1150*t*-2 and sixth guide portion 1150*t*-6.

Guide portions may also be included to aid in guiding bars from a mating connector into openings 1152. The seventh and eighth guide portions 1150*t*-7 and 1150*t*-8 may be a part of the spaced apart portions 1150*b*. Those guide portions may similarly extend above the upper edge of the wall 1116 of the housing 1112. A maximum height of the receptacle connector 1000 may be located at the upper edge of the first and/or second guide portions 1150*t*-1 and 1150*t*-2.

In the example shown in FIGS. 2A-2D, the shell may be retained with projections, here shaped as hooks, that engage the insulative housing. The shell 1150 may include hooks 1158 configured to engage with the wall 1116 and secure the shell 1150 to the wall 1116 at a predetermined position relative to each other. In some embodiments of the present technology, the hooks 1158 may be structured to engage with notched portions 1116*c* on the upper edge of the wall 1116 such that, in an engaged position, an external surface of each of the hooks does not protrude beyond the upper edge of the wall 1116, as depicted in FIG. 2A. For example, the external surface of each of the hooks 1158 may be structured to align with the upper edge of the wall 1116 on one side of the wall 1116.

When the shell 1150 and the wall 1116 are in the engaged position such that they are at the predetermined position relative to each other, a mating process for mating the plug connector 2000 with the receptacle connector 1000 may be performed predictably and reproducibly to achieve the mated position. The hooks 1158 and the notched portions 1116*c* may be structured to help a user confirm that the shell 1150 and the housing 1112 are oriented properly relative to each other during assembly of the receptacle connector 1000.

Figure 5A:
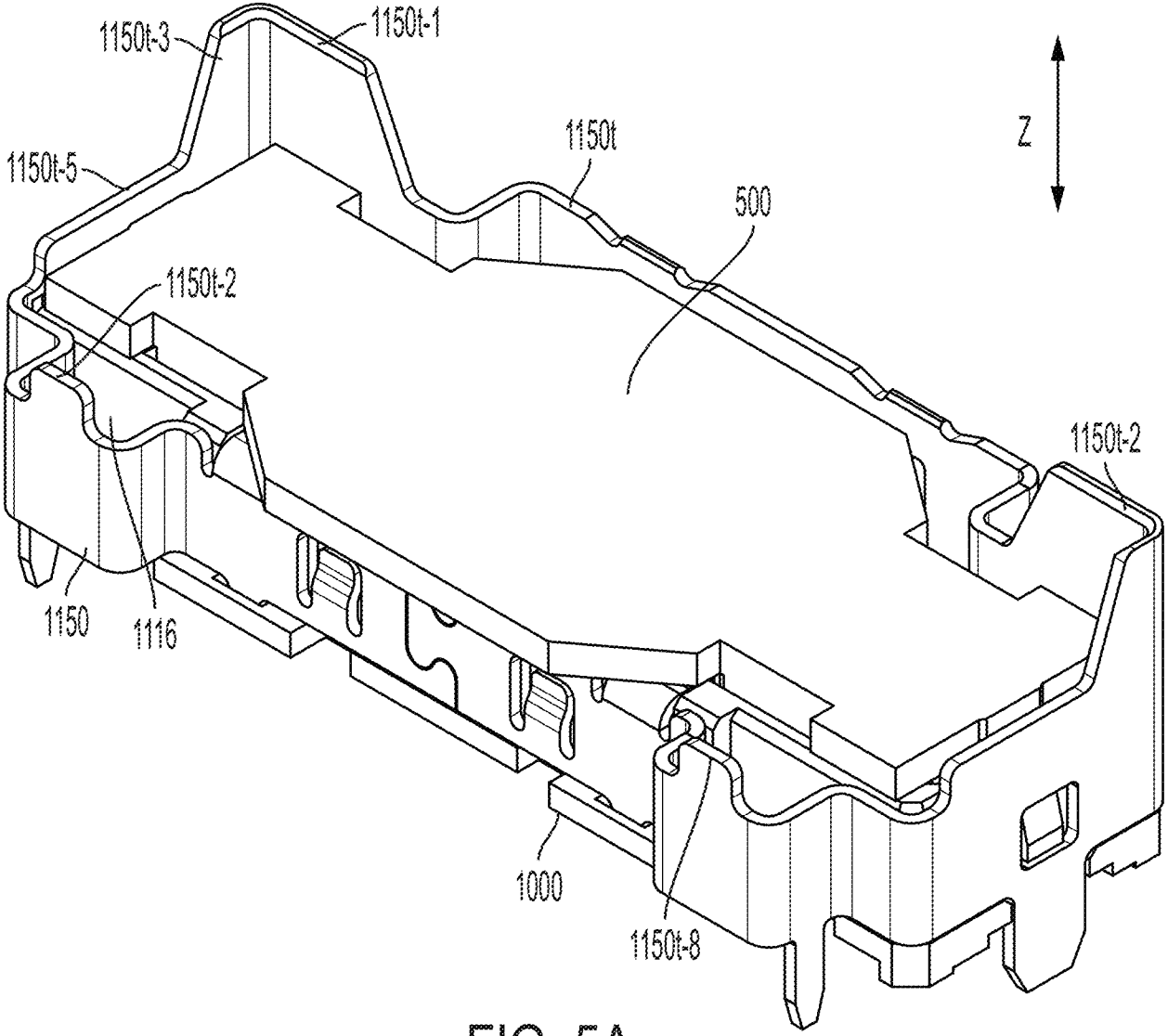
FIG. 5A is a perspective view of a receptacle connector with a cover, according to some embodiments of the present technology.

By having the hooks 1158 structured to fit into a recess formed by the notched portions 1116*c*, the shell 1150 may advantageously permit a cover 500 to be applied to the receptacle connector 1000 when the receptacle connector 1000 is not mated with the plug connector 2000, as depicted in FIG. 5A. The cover 500 may be used to protect the terminals 1122 of the terminal assembly 1190 and enable the receptacle connector to be picked up with a vacuum gripper for placing on a printed circuit board.

Figure 5C:
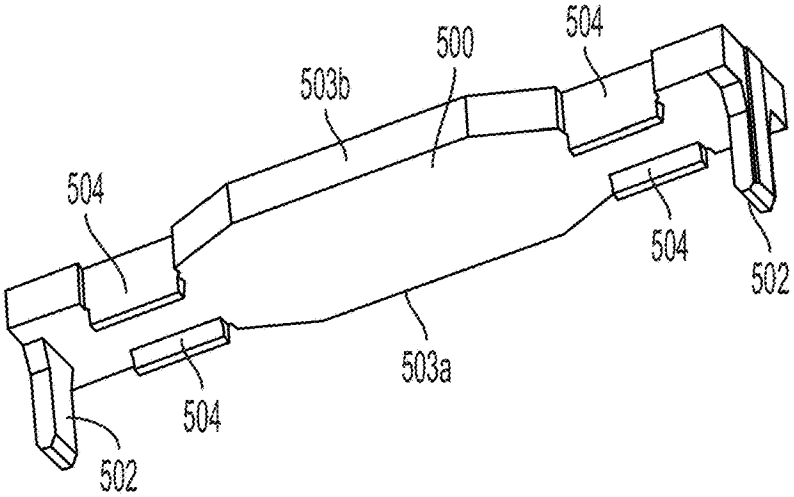
FIG. 5C is a bottom perspective view of the cover of FIG. 5A.
Figure 5B:
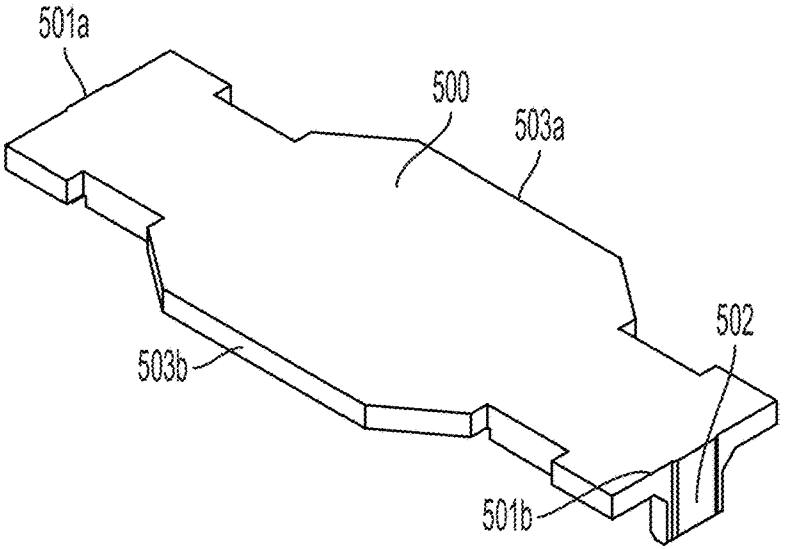
FIG. 5B is a top perspective view of the cover of FIG. 5A.

FIGS. 5B and 5C depict a top and bottom perspective views of the cover 500, respectively. Legs 502 may extend perpendicularly from two opposite ends 501*a*, 501*b* of the cover 500, and the legs 502 may be structured to be inserted in a space between island 1120 and each of the shorter sides 1116*b* of the wall 1116, when the cover 500 is in place to protect the terminals 1122. Similarly, tabs 504 may extend perpendicularly from other parts of the cover 500 to restrict movement of the cover 500 relative to the receptacle connector 1000. In one example, shown in FIG. 5C, the tabs 504 may extend from two opposite sides 503*a*, 503*b* of the cover 500. Each of the ends 501*a*, 501*b* of the cover may have at least one leg 502, and each of the sides 503*a*, 503*b* of the cover may have at least one tab 504. That is, the cover 500 may have a flat surface that rests on top of the island 1120, when the cover 500 is in place to protect the terminals 1122.

An orientation of the receptacle connector 1000 may be easily determined by a user via the shell 1150, which may be structured to have a tall side 1150*t*. The tall side 1150*t* may have at least one region having a maximum height, in the axial direction Z, greater than a height of any other region of the shell 1150. For example, as depicted in FIG. 5A, the tall side 1150*t* of the shell 1150 may have guide portions 1150*t*-1 and 1150*t*-2 having a height greater than any other part of the receptacle connector 1000. This may enable a user to recognize, for example, a side of the receptacle connector 1000 on which is located the space 1152' for receiving the bar-shaped member 2012 of the plug connector 2000. Also, the tall side 1150*t* may advantageously serve as a stop for the cover 500 when, for example, the cover 500 is being positioned on the receptacle connector 1000.

Referring back to FIG. 2C, the wall 1116 of the housing 1112 may include recessed portions 1116*r* configured to receive latching portions 1159 of the shell 1150. The latching portions 1159 may prevent the shell 1150 from sliding off the housing 1112 when the receptacle connector 1000 is in an assembled state. For example, the recessed portions 1116*r* may be disposed on one or both of the two longer sides 1116*a* of the wall 1116, and the latching portions 1159 may be disposed on one or both of the two longer sides 1150*d* of the shell 1150. When the shell 1150 and the housing 1112 are assembled together, the latching portions 1159 may latch with the recessed portions 1116*c* to make snap-fit connections and prevent movement of the shell 1150 relative to the housing 1112. The recessed portions 1116*c* may be formed partially or completely through a thickness of the wall 1116. The shell 1150 may be formed of metal, and the latching portions 1159 may be portions of the shell 1150 that are cut and bent to form springy tabs or latches that engage with the recessed portions 1116*c*. The shell 1150 also may include lock holes 1160 that are structured to engage with barbs 1161 on the housing 1112 such that, when the shell 1150 and the housing 1112 are assembled together, the lock holes 1160 and the barbs 1161 prevent slipping movement of the shell 1150 relative to the housing 1112. For example, the shell 1150 may be sufficiently resilient such that during assembly the shell 1150 may flex slightly to enable to barbs 1161 to snap into the lock holes 1160. Each of the barbs 1161 may be structured with an angled surface on one side and a ledge surface on an opposite side, which may enable the barbs 1161 to snap in place easily via the angled surface during assembly, and to lock in place via the ledge surface after assembly, so that the shell 1150 and the housing 1112 may not be easily separated from each other.

Figure 6B:
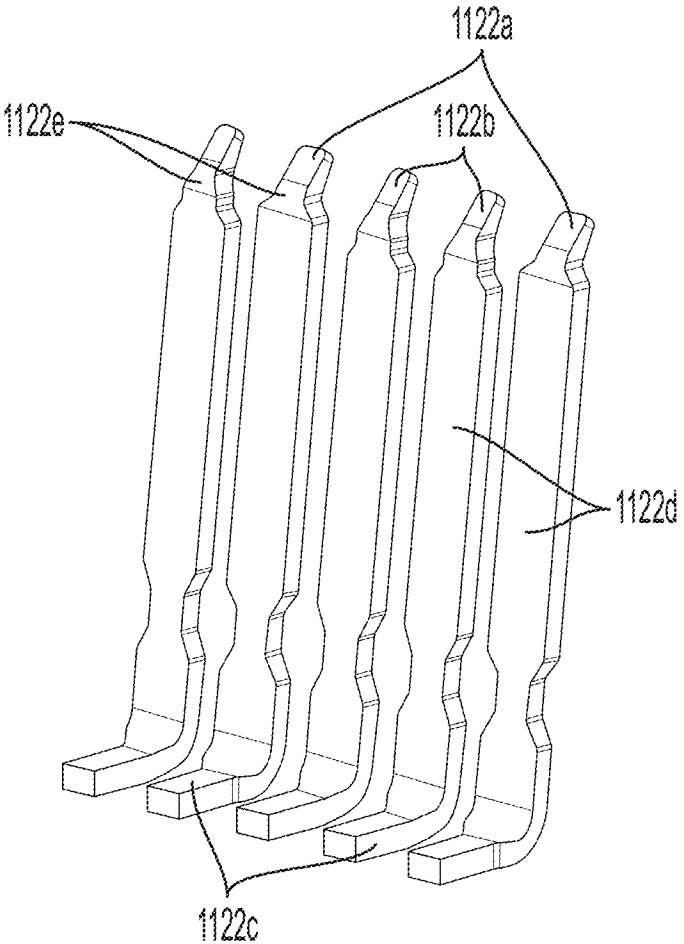
FIG. 6B is a perspective view of terminals of the terminal assembly of FIG. 6A.
Figure 6A:
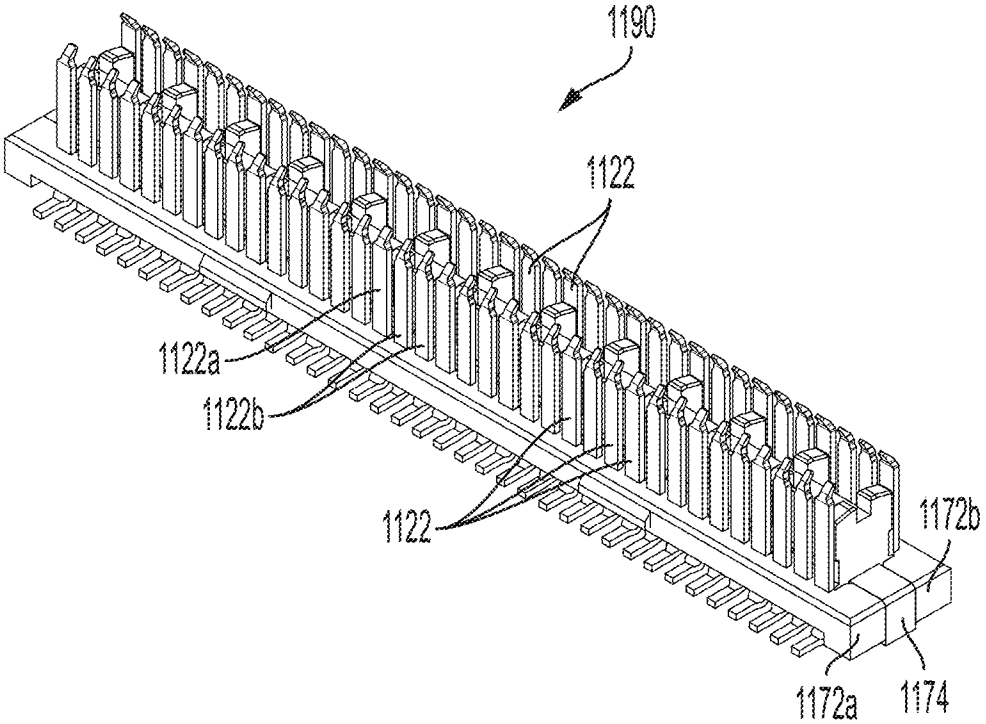
FIG. 6A is a perspective view of a terminal assembly, according to some embodiments of the present technology.
Figure 6C:
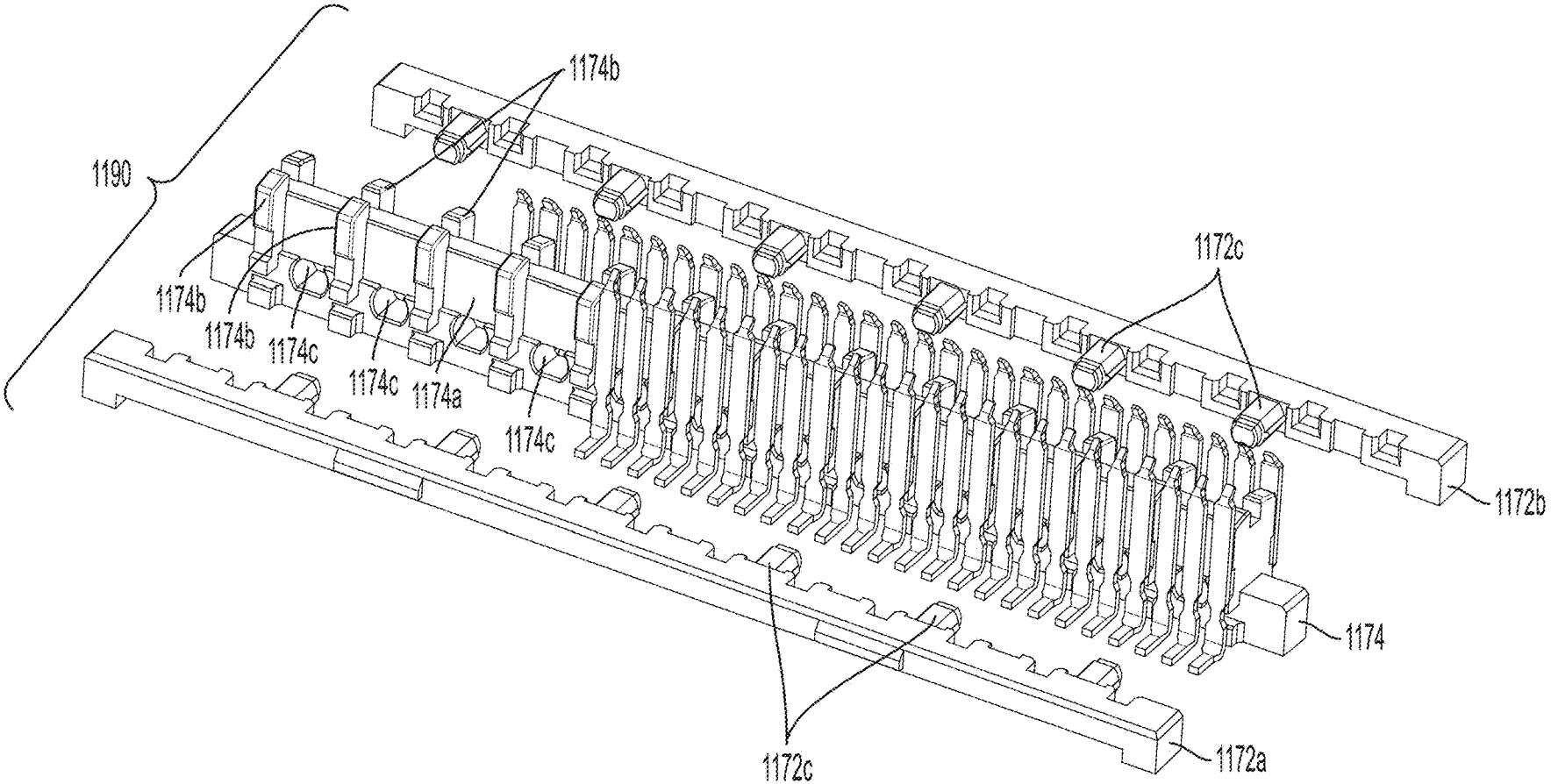
FIG. 6C is a perspective view of portions of the terminal assembly of FIG. 6A in a partially disassembled state.
Figure 6D:
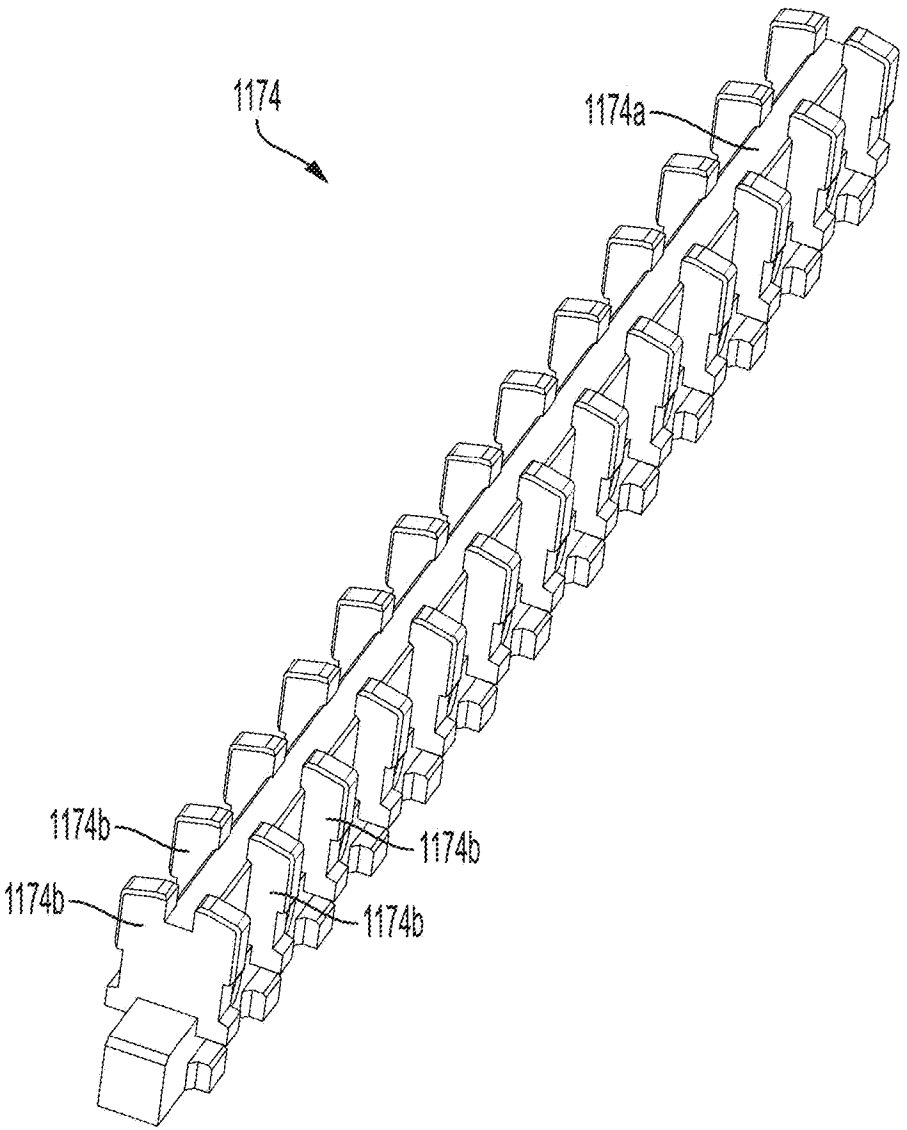
FIG. 6D is a perspective view of a central bar of the terminal assembly of FIG. 6A.

FIG. 6A depicts a perspective view of the terminal assembly 1190 of the housing assembly 1110. The terminals 1122 of the terminal assembly may include ground terminals 1122*a* and signal terminals 1122*b*, as depicted in FIG. 6B. FIG. 6C depicts a disassembled view of the terminal assembly 1190, with some of the terminals 1122 hidden to reveal various structural aspects of the terminal assembly 1190.

The terminal assembly 1190 may include first and second terminal bars 1172*a*, 1172*b* and a central bar 1174 that may be sandwiched between the first and second terminal bars 1172*a*, 1172*b* when the terminal assembly 1190 is in an assembled state. Each terminal 1122, (i.e., 1122*a*, 1122*b*) may have a mounting portion 1122*c*, an intermediate portion 1122*d*, and a tail 1122*e*. The central bar 1174 may be formed of an electrically lossy material.

The mounting portion 1122*c*, which may be hooked relative to the intermediate portion 1122*d*, may configured to be mounted to a PCB by, for example, a SMT solder-mounting technique or another bonding technique. The tail 1122*e* may be hooked relative to the intermediate portion 1122*d*. In FIG. 6B, the tails 1122*e* are shown to be hooked in a first direction relative to the intermediate portions 1122*d*, and the mounting portions 1122*c* are shown to be hooked in a second direction generally opposite to the first direction. It should be appreciated that the configurations shown in FIG. 6B are merely examples, and the terminals 1122*a*, 1122*b* may have other configurations than those shown.

The mounting portion 1122*c* may be considered a fixed end of the terminal 1122, because the mounting portion 1122*c* is intended to be fixed to, e.g., a PCB (not shown). In contrast, the tail 1122*e* may be considered a distal free end of the terminal 1122, because the tail 1122*e* is not constrained but instead may move in response to a force applied to various portions of the terminal 1122, including a force applied by the plug connector 2000 when mated to the receptacle connector 1000 in which the terminal 122 is disposed. For example, the mounting portions 1122*c* may extend through the first and second terminal bars 1172*a*, 1172*b*, such that the mounting portions 1122*c* may be externally exposed on the housing assembly 1110 to enable connections (e.g., solder connections) to be made to the mounting portions 1122*c*.

The terminals 1122 may be arranged in two parallel rows sandwiching the central bar 1174 in between. The mounting portions 1122*c* of the terminals 1122 may be configured to hook away from the central bar 1174. The terminals 1122 may be molded in place in the first and second terminal bars 1172*a*, 1172*b* to form the two parallel rows. Alternatively, the first and second terminal bars 1172*a*, 1172*b* may be positioned respectively against the terminals 1122 to hold the terminals 1122 in place in the two parallel rows.

The central bar 1174 may include a support portion 1174*a*, which may extend along a length of the central bar 1174, and projections 1174*b* that extend laterally from the central bar 1174 and that are structured to come into contact with the ground terminals 1122*a*. For example, each of the ground terminals 1122*a* in the two parallel rows on the first and second terminal bars 1172*a*, 1172*b* may be separated from another of the ground terminals 1122*a* in the same row by a pair of signal terminals 1122*b*; the projections 1174*b* may be structured to contact the intermediate portions 1122*d* of the ground terminals 1122*a*, but may not connect the signal terminals 1122*b*.

The intermediate portions 1122*d* and the tails 1122*e* may extend into an interior cavity of the island 1120 such that a segment of each of the terminals 1122 may be exposed through the channels or slots 1124 in the island 1120 and may make contact with corresponding terminals in the plug connector 2000.

Each of the first and second terminal bars 1172*a*, 1172*b* may include projections 1172*c* structured to be received in openings 1174*c* in the central bar 1174. For example, the projections 1172*c* of the first terminal bar 1172*a* may be staggered relative to the projections 1172*c* of the second terminal bar 1172*b*, such that two adjacent openings 1174*c* may receive one projection 1172*c* from the first terminal bar 1172*a* and one projection 1172*c* from the second terminal bar 1172*b*. When the terminal assembly 1190 is in an assembled state, the projections 1172*c* in the openings 1174*c* may act to prevent displacement or shifting of the terminals 1122.

An electrical connector according to the technology described herein may be embodied in different configurations. Example configurations include combinations of configurations (1) through (12), as follows:

(1) An electrical connector comprising: a housing comprising a bottom and a wall bounding, at least in part, an opening adjacent the bottom; an island protruding from the bottom of the housing and into the opening; a plurality of terminals supported by the island; and a shell configured to encircle an outer surface of the wall, wherein the shell is comprised of: a plurality of first portions configured to conform with the outer surface of the wall, a plurality of second portions spaced apart from the outer surface of the wall, and a plurality of hook portions configured to engage with an edge of the wall.

(2) The electrical connector of configuration 1, wherein: the wall of the housing has first and second longer sections connected to first and second shorter sections, at least one of the first portions of the shell and at least one of the second portions of the shell are located along the first longer section of the wall, and at least one of the first portions of the shell and at least one of the second portions of the shell are located along the second longer section of the wall.

(3) The electrical connector of any of configurations 1 through 2, wherein a number of the at least one of the first portions of the shell located along the first longer section of the wall is different from a number of the at least one of the second portions of the shell located along the first longer section of the wall.

(4) The electrical connector of any of configurations 1 through 3, wherein a number of the at least one of the first portions of the shell located along the second longer section of the wall is different from a number of the at least one of the second portions of the shell located along the second longer section of the wall.

(5) The electrical connector of any of configurations 1 through 4, wherein the outer surface of the wall and the plurality of second portions of the shell form a plurality of spaces configured to receive a plurality of mating portions of a mating connector therein when the mating connector is in a mating position with the electrical connector.

(6) The electrical connector of any of configurations 1 through 5, wherein the plurality of spaces are arranged such that the electrical connector has a single mating position with the mating connector.

(7) The electrical connector of any of configurations 1 through 6, wherein the plurality of spaces include: a first space located along the first longer section of the wall, the first space having a length greater than about half a length of the first longer section in a second direction, and a plurality of second spaces located along the second longer section of the wall, each of the second spaces having a length less than about a quarter of a length of the second longer section in the second direction.

(8) The electrical connector of any of configurations 1 through 7, wherein: the first space is configured to receive a bar-shaped portion of the mating connector, and each of the second spaces is configured to receive a leg of the mating connector.

(9) The electrical connector of any of configurations 1 through 8, wherein a maximum height of the shell in a first direction is greater than a maximum height of the wall in the first direction.

(10) The electrical connector of any of configurations 1 through 9, wherein: the wall of the housing has first and second longer sections connected to first and second shorter sections at four corners, the shell has four corners configured to conform with the four corners of the wall, and the maximum height of the shell is at two of the four corners.

(11) The electrical connector of any of configurations 1 through 9, wherein the shell is comprised of a plurality of legs extending in the first direction and configured to engage with a printed circuit board (PCB).

(12) The electrical connector of any of configurations 1 through 11, wherein an edge of the wall includes a plurality of notches configured to engage with the plurality of hook portions of the shell.

An electrical connector according to the technology described herein may be embodied in different configurations. Example configurations include combinations of configurations (13) through (21), as follows:

(13) An electrical connector comprising: an insulative housing comprised of a bottom and a wall extending from the bottom at a periphery of the bottom; an island protruding from the bottom of the housing and spaced apart from the wall of the housing, wherein the island supports a plurality of electrical terminals; and a shell configured to encircle an outer surface of the wall, wherein the shell is comprised of: a first portion configured to conform with the outer surface of the wall, a plurality of second portions spaced apart from the outer surface of the wall, and a plurality of hook portions configured to engage with an edge of the wall.

(14) The electrical connector of configurations 13, wherein each of the second portions of the shell bounds a space between the outer surface of the wall, and each of the spaces is configured to receive a portion of a mating connector therein.

(15) The electrical connector of any of configurations 13 through 14, wherein: the wall is comprised of first and second longer wall portions and first and second shorter wall portions, at least one of the spaces is located along each of the first and second longer wall portions, and the first portion of the shell conforms with the outer surface of the wall at the first and second shorter wall portions.

(16) The electrical connector of any of configurations 13 through 15, wherein a number of the second portions of the shell located along the first longer wall portion is different from a number of the second portions of the shell located along the second longer wall portion.

(17) The electrical connector of any of configurations 13 through 16, wherein the spaces are arranged such that the electrical connector has a single mating position with the mating connector.

(18) The electrical connector of any of configurations 13 through 17, wherein the spaces include: a first space located along the first longer wall portion, the first space having a length greater than about half a length of the first longer wall portion in a length direction, and a plurality of second spaces located along the second longer wall portion, each of the second spaces having a length less than about a quarter of a length of the second longer wall portion in the length direction.

(19) The electrical connector of any of configurations 13 through 18, wherein a maximum height of the shell in a height direction is greater than a maximum height of the wall in the height direction.

(20) The electrical connector of any of configurations 13 through 19, wherein: the wall of the housing has four corners, the shell has four corners configured to conform with the four corners of the wall, and the maximum height of the shell is at two of the four corners.

(21) The electrical connector of any of configurations 13 through 20, wherein an edge of the wall includes a plurality of notches configured to engage with the plurality of hook portions of the shell.

Methods of mating a plug connector and a receptacle connector according to the technology described herein may be include various processes. Example methods include combinations of processes (22) through (23), as follows:

(22) A method of mating a plug connector and a receptacle connector, the method comprising: aligning the plug connector with the receptacle connector by engaging a bar extending from the plug connector with a first space located between a shell of the receptacle connector and a housing wall of the receptacle connector, engaging a plurality of legs extending from the plug connector with a plurality of second spaces located between the shell of the receptacle connector and the housing wall of the receptacle connector, and engaging a cavity of the plug connector with an island protruding from a housing bottom of the receptacle connector; and, after the aligning, pressing the plug connector towards the receptacle connector, wherein: the first space is located along a first long side of the receptacle connector, the second spaces are located along a second long side of the receptacle connector, the island supports a plurality of electrical receptacle terminals exposed on an outer surface of the island, a plurality of electrical plug terminals are exposed on a surface of the cavity and are configured to engage with the receptacle terminals when the plug connector and the receptacle connector are in a mated position, and the mated position is a single position in which the plug connector aligns with the receptacle connector.

(23) The method of process 22, wherein the pressing of the plug connector towards the receptacle connector is in a direction orthogonal to a housing bottom of the receptacle connector and orthogonal to a cavity bottom of the plug connector.

CONCLUSION

It should be understood that various alterations, modifications, and improvements may be made to the structures, configurations, and methods discussed above, and are intended to be within the spirit and scope of the invention disclosed herein. Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "*a*" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

"Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector comprising: a housing comprising a bottom and a wall bounding, at least in part, an opening adjacent the bottom, the wall including shorter sections and longer sections, the shorter sections of the wall extending parallel to a first direction, the longer sections of the wall extending parallel to a second direction different from the first direction; an island protruding from the bottom of the housing and into the opening; a plurality of terminals supported by the island; and a shell configured to encircle an outer surface of the wall, wherein the shell is comprised of: a plurality of first portions configured to conform with the outer surface of the wall, a plurality of second portions spaced apart from the outer surface of the wall, and a plurality of hook portions engaged with an edge of the wall, wherein the outer surface of the wall and the plurality of second portions of the shell bound a plurality of spaces extending parallel to the wall and being configured to receive therein a plurality of mating portions of a mating connector when the mating connector is in a mating position with the electrical connector; and wherein the plurality of spaces include: a first space extending parallel to the second direction, the first space having a first area, and a second space extending parallel to the second direction, the second space having a second area different from the first area.

2. The electrical connector of claim 1, wherein the wall of the housing has first and second longer sections connected to first and second shorter sections, at least one of the first portions of the shell and at least one of the second portions of the shell are located along the first longer section of the wall, and at least one of the first portions of the shell and at least one of the second portions of the shell are located along the second longer section of the wall.

3. The electrical connector of claim 2, wherein a number of the at least one of the first portions of the shell located along the first longer section of the wall is different from a number of the at least one of the second portions of the shell located along the first longer section of the wall.

4. The electrical connector of claim 3, wherein a number of the at least one of the first portions of the shell located along the second longer section of the wall is different from a number of the at least one of the second portions of the shell located along the second longer section of the wall.

5. The electrical connector of claim 2, wherein the at least one of the second portions of the shell located along the first longer section of the wall and the at least one of the second portions of the shell located along the second longer section of the wall have no portions positioned opposite each other when viewed in a plan view.

6. The electrical connector of claim 1, wherein the plurality of spaces are arranged such that the electrical connector has a single mating position with the mating connector.

7. The electrical connector of claim 1, wherein:

the first space has a first length that is greater than about half a length of the first longer section, the first length extending parallel to the second direction, and the second space has a second length that is less than about a quarter of a length of the second longer section, the second length extending parallel to the second direction.

8. The electrical connector of claim 7, wherein the first space is configured to receive a bar-shaped portion of the mating connector, and the second space is configured to receive a leg of the mating connector.

9. The electrical connector of claim 1, wherein a maximum height of the shell in a height direction is greater than a maximum height of the wall in the height direction, the height direction being perpendicular to the first and second directions.

10. The electrical connector of claim 9, wherein the wall of the housing has first and second longer sections connected to first and second shorter sections at four corners, the shell has four corners configured to conform with the four corners of the wall, and the maximum height of the shell is at two of the four corners.

11. The electrical connector of claim 9, wherein the shell is comprised of a plurality of legs extending parallel to the height direction, the legs being configured to engage with a printed circuit board (PCB).

12. The electrical connector of claim 1, wherein the edge of the wall includes a plurality of notches configured to engage with the plurality of hook portions of the shell.

13. The electrical connector of claim 1, wherein a plurality of ledge portions extend laterally from an outer surface of the wall, at a lower edge of the wall, the plurality of ledge portions being configured to support the shell thereon and to limit a position of the shell relative to the housing.

14. The electrical connector of claim 1, wherein at least some of the plurality of first portions of the shell conform with the outer surface of the wall of the housing such that no gap is present between the outer surface of the wall and the at least some of the plurality of first portions of the shell.

15. The electrical connector of claim 1, wherein the shell includes a plurality of lock holes configured to snap-fit with a plurality of barbs extending from an outer surface of the housing, and, when the shell and the housing are in an assembled state, the lock holes and the barbs prevent the shell from moving relative to the housing.

16. The electrical connector of claim 1, wherein the shell includes a plurality of latching portions configured to snap-fit with a plurality of recessed portions in an outer surface of the housing, and, when the shell and the housing are in an assembled state, the latching portions and the recessed portions prevent the shell from moving relative to the housing.

17. An electrical connector comprising:

an insulative housing comprising a bottom and a wall extending from the bottom at a periphery of the bottom, the wall comprising first and second longer wall portions and first and second shorter wall portions and bounding a cavity;

a plurality of electrical terminals supported by the insulative housing and having mating portions exposed within the cavity; and a shell encircling an outer surface of the wall, wherein:

the shell comprises first and second longer shell portions and first and second shorter shell portions, the first longer shell portion is adjacent the first longer wall portion and has first and second guide portions extending parallel to and above the first longer wall portion, the first and second guide portions being configured to guide a mating connector when the mating connector is being mated with the electrical connector, the second longer shell portion is adjacent the second longer wall portion, and the shell further comprises a projection engaged with the second longer wall portion.

18. The electrical connector of claim 17, wherein:

the shell comprises:

a first portion configured to conform with the outer surface of the wall, and a plurality of second portions spaced apart from the outer surface of the wall, each of the second portions of the shell bounds a space between the outer surface of the wall, and each of the spaces extends parallel to the outer surface of the wall and is configured to receive a portion of the mating connector therein.

19. The electrical connector of claim 18, wherein at least one of the spaces is located along each of the first and second longer wall portions, and the first portion of the shell conforms with the outer surface of the wall at the first and second shorter wall portions.

20. The electrical connector of claim 17, wherein the projection comprises a hook, hooked over an edge of the second longer wall portion.

21. The electrical connector of claim 17, wherein:

the first shorter shell portion comprises a third guide portion extending above and parallel to the first shorter wall portion;

the second shorter shell portion comprises a fourth guide portion extending above and parallel to the second shorter wall portion.

22. The electrical connector of claim 21, wherein:

the wall has an upper edge;

the third guide portion is attached to the first guide portion;

the fourth guide portion is attached to the second guide portion; and the first and second guide portions are separated by segments of the shell having edges aligned with the upper edge of the wall; and the third and fourth guide portions are separated by segments of the shell having edges aligned with the upper edge of the wall.

23. The electrical connector of claim 22, wherein the wall of the housing has four corners, the shell has four corners configured to conform with the four corners of the wall, and the maximum height of the shell is at two of the four corners.

24. The electrical connector of claim 17, wherein an edge of the second longer wall comprises a notch and the projection extends into the notch such that the projection engages with the second longer wall at the notch.

25. A method of mating a plug connector and a receptacle connector comprising an insulative housing and a shell, the method comprising:

aligning the plug connector with the receptacle connector by:

positioning the plug connector with guide portions of the shell;

engaging a bar extending from the plug connector with a first space located between a shell of the receptacle connector and a housing wall of the receptacle connector, engaging a plurality of legs extending from the plug connector with a plurality of second spaces located between the shell of the receptacle connector and the housing wall of the receptacle connector, and engaging a cavity of the plug connector with an island protruding from a housing bottom of the receptacle connector; and after the aligning, pressing the plug connector towards the receptacle connector, wherein the first space is located along a first long side of the receptacle connector, the second spaces are located along a second long side of the receptacle connector, the island supports a plurality of electrical receptacle terminals exposed on an outer surface of the island, a plurality of electrical plug terminals are exposed on a surface of the cavity and are configured to engage with the receptacle terminals when the plug connector and the receptacle connector are in a mated position, and the mated position is a single position in which the plug connector aligns with the receptacle connector.

26. The method of claim 25, wherein the pressing of the plug connector towards the receptacle connector is in a direction orthogonal to a housing bottom of the receptacle connector and orthogonal to a cavity bottom of the plug connector.

* * * * *